US008062120B2

(12) United States Patent
Zapata et al.

(10) Patent No.: US 8,062,120 B2
(45) Date of Patent: Nov. 22, 2011

(54) DYNAMIC CARD SYSTEM AND METHOD

(76) Inventors: Charles Zapata, Redmond, WA (US); Daniel J. Shapiro, Redmond, WA (US)

( * ) Notice: Subject to any disclaimer, the term of this patent is extended or adjusted under 35 U.S.C. 154(b) by 1528 days.

(21) Appl. No.: 11/379,766

(22) Filed: Apr. 21, 2006

(65) Prior Publication Data

US 2010/0261519 A1 Oct. 14, 2010

(51) Int. Cl.
*A63F 1/00* (2006.01)

(52) U.S. Cl. ..... 463/22; 463/9; 463/11; 463/12; 463/43; 463/46

(58) Field of Classification Search ..... 463/22, 463/9, 11, 12, 43, 46
See application file for complete search history.

(56) References Cited

U.S. PATENT DOCUMENTS 5,823,879 A * 10/1998 Goldberg et al. ..... 463/42
5,841,119 A * 11/1998 Rouyrre et al. ..... 235/380
6,638,161 B2 * 10/2003 Soltys et al. ..... 463/12
6,991,540 B2 * 1/2006 Marlow ..... 463/16
2002/0155869 A1 * 10/2002 Soltys et al. ..... 463/11
2003/0214612 A1 * 11/2003 Freeman ..... 349/12
2004/0180476 A1 * 9/2004 Kazlas et al. ..... 438/146
2004/0248073 A1 * 12/2004 Pinkerman et al. ..... 434/308
2005/0255905 A1 * 11/2005 Duke et al. ..... 463/17
2006/0092108 A1 * 5/2006 Ozaki ..... 345/76
2006/0181763 A1 * 8/2006 De Zwart et al. ..... 359/296
2009/0289414 A1 * 11/2009 Bergman et al. ..... 273/149 R

* cited by examiner

*Primary Examiner* — Dmitry Suhol
*Assistant Examiner* — Matthew Russell
(74) *Attorney, Agent, or Firm* — AEON Law; Adam L. K. Philipp

(57) ABSTRACT

A dynamic entertainment playing card having a flexible electronic display and a processor is configured to change state during a card game based on input received by the card during the card game and applied to a set of game rules by the processor. The card display is configured to display changing images on the face of the card during game play according to the changing card state.

104 Claims, 16 Drawing Sheets

DYNAMIC CARD SYSTEM AND METHOD

BACKGROUND

Traditional card games, such as poker, contract bridge, and the like, have been played using a predetermined number of deck cards. For example, a conventional deck or pack of playing cards is composed of fifty-three or fifty-four cards, namely, thirteen spades, thirteen hearts, thirteen clubs, thirteen diamonds and one or two jokers. In most card games, a conventional deck (or decks) of playing cards is shared among players joining a game.

In the gaming industry there is a significant volume of gambling which occurs at live table games that use playing cards. Exemplary live table games include blackjack, poker, baccarat, and others. These and many other games all involve play using playing cards. The use of playing cards has a number of associated limitations and disadvantages which have plagued the gaming industry.

The use of playing cards at live table games typically involves several operational requirements which are time-consuming. These operations are conveniently described as collecting, shuffling and dealing the cards. In many card games there is also a step of cutting the deck after it has been shuffled.

In the collecting operation, a dealer typically collects the cards just played at the end of a hand of play. This is done in preparation for playing the next hand of cards. The cards are best collected so all are in a face-down or face-up condition. The cards also are typically straightened into a stack with the long sides and short sides aligned. These manipulations take time and are not typically appreciated by either the dealer or players as enhancing the play and entertainment value of the game.

In many games the cards collected at the end of the hand are deposited in a discard rack, which collects the played cards until the time a new stack is obtained or the stack is shuffled. In some games the cards are immediately shuffled into the stack either manually or using a shuffling machine. More typically, the cards are collected and then shuffling is performed later by the dealer.

When conventional shuffling is needed, it involves a break in the action of the table game and consumes a significant amount of time. Shuffling is also the most time-consuming operation in preparing for the next hand. Thus, shuffling is of substantial financial significance to the gaming industry because it requires significant time and reduces the number of hands which can be played per hour or other period of time. In light of this, there has been interest by casino owners to develop practices which allow more games to be played in a given amount of time. Accomplishing this without detracting from the players' enjoyment and desire to play the game is a challenging and longstanding issue for casino owners and consultants in the gaming industry.

An additional consideration in the casino industry is the costs associated with shuffling machines. Shuffling machines currently available have costs in the thousands of dollars. Such machines save time in performing the shuffling process, but still require time to load, operate and unload. These factors reduce the savings associated with reduced shuffling time and effort.

Another form of cards used for entertainment are trading cards. Some forms of trading card can be rare and difficult to obtain. Playing cards, as distinguished from trading cards, are often readily available. This is especially true of the well-known decks of fifty-two (or fifty-three or fifty-four) playing cards. Many different games can be played with a single deck of this type of playing cards. The number of games possible is limited for the most part only by the imagination of the players. Playing cards themselves, individually and collectively, usually have no value other than their amusement value. Similarly, some card games require decks especially printed for the game. Cards of this nature have little value other than their value for the playing of the particular game for which they are printed.

Many games played with conventional playing cards are games of chance. Games of chance can have rules that either require the random selection of cards or depend in some other way upon the occurrence of events outside the control of the players. Other games played with conventional cards may require strategy. Strategy games usually limit the level of strategy with restrictive rules of play.

However, collectible card games have made a significant impact on both the trading card industry and on the game industry. Collectible cards suitable for use in playing games of this nature are also known as fantasy trading cards. Exemplary fantasy trading cards represent fictional characters and situations.

One such game is a fantasy game utilizing figures such as sorcerers, wizards, monsters, and other combatants as subject matter. Another such game utilizes a science fiction universe previously created for television and movie entertainment. Fantasy games may often include cards that are rarer than other cards. However, determining which cards may be more rare is not integral when using the cards, rather each card or combination of cards has characteristics that may be used in strategic game play.

Conventionally, a wide variety of such fantasy trading card games have been also proposed, each of which has its fans. In contrast to the conventional card decks, such fantasy trading card games are usually played with decks of cards which are different from one another (and may not have an equal number of cards). However, it is to be noted that many of the fantasy trading card games are common to one another in the viewpoint of being played through the following three stages.

At the first stage, players of each fantasy trading card game gather their cards from various kinds of cards that have been issued in order to build their collection. Each species of card has a different effect in the game and in many cases, the more effective a card is, the fewer numbers of that card are issued (i.e., better cards are often rarer). A pack of cards is often sold with opaque packaging so that players cannot identify the contents or species of cards packaged before they purchase them. As a result, decks purchased by players would have different card constructions from each other, and if a player wants to build a powerful deck, the player has to collect (and possibly trade) cards.

At the second stage, each player selects a number of cards from their collection to build a deck. Usually, a card has ability points and properties, and an ability point may be modified according to its property. Furthermore, there are cards that have special effects in addition to or instead of ability points and properties. Therefore, in order to build a desirable deck, each player must not only collect cards with high ability points but also select cards suitable for their game strategy, taking into consideration various cards' properties and special effects. A good player may build a suitable deck if the player knows their opponent's card list.

At the third stage, two (or more) players individually prepare their decks from their collections of cards and thereafter start a trading card game among them. They draw one or more cards for their hands from their decks and then each of them puts a card from his hand on a game field by turns. Card-tocard matches are made between cards on the field repeatedly and after a series of matches a winner or a loser of the game is decided.

At the first stage mentioned above, players have fun collecting cards to strengthen their collections. A card provider (e.g., a company that creates and distributes the cards) who provides the fantasy trading card game should increase the number of types of cards to enhance each player's game experience. However, to ensure that players enjoy the game, game balance should be preserved. While some players may clamor for more powerful cards, unchecked increases in the introduction of powerful cards is likely to destroy the balance of game. Specifically, if a lot of species of cards that have high ability points are introduced, then players who have acquired these cards may become too powerful for beginning players to enjoy playing the game with them.

Many fantasy trading card games have been computerized as video games. Compared with the live fantasy trading card games, such conventional computerized trading card games do not allow for the collection and trading of individual cards between players, thereby omitting some of the fun from the collecting phase of the trading card games. Likewise, it is difficult to incrementally increase the number of card species within a video game beyond what was originally included in the video game. Accordingly, a great number of card species and cards have to be prepared in advance in each computerized trading card game before the beginning to supplying the game to players. On the other hand, paper-printed trading card games can easily increase card species simply by issuing new card species in addition to the existing card species. Players with the new card(s) and players without new cards can still play the game together.

Other forms of trading cards include collectible cards for disbursing and collecting information about public figures. For example, trading cards representing figures in the entertainment industry can depict music performers or television and movie personalities. More familiar types of trading cards are the well-known baseball and other sports player cards. Baseball cards are often provided with a photographic depiction of an athlete along with biographic and statistical information concerning various athletes and teams. Other cards dealing with sports figures are also available and are used by sports enthusiasts for collecting information about athletes and sports teams.

Additionally, trading cards directed to niche markets continue to develop. The sports and non-sports subject matter can be as varied and obscure as women's bowling, bass fishing and National Historical Parks. However, the most successful sets are those with wide appeal that contain opportunities to have ongoing content for the cards. This partly accounts for the success of sports cards. However, any type of cards can be used by enthusiasts of the subject matter as trading cards.

Enthusiasts may exchange trading cards with other enthusiasts in order to obtain cards that are needed to complete sets of related cards or to obtain cards that are not readily available. Collectors can also buy and sell trading cards for their economic and historic value. Since some trading cards are more common than others, the monetary value of a card can depend on its availability.

In addition to new card games and software games for playing card games, communications between electronic devices have also improved in recent years. Communication networks are well known in the computer communications field. By definition, a network is a group of computers and associated devices that are connected by communications facilities or links. Network communications can be of a permanent nature, such as via cables, or can be of a temporary nature, such as connections made through telephone or wireless links. Networks may vary in size, from a local area network ("LAN"), consisting of a few computers or workstations and related devices, to a wide area network ("WAN"), which interconnects computers and LANs that are geographically dispersed, to a remote access service, which interconnects remote computers via temporary communication links. An internetwork, in turn, is the joining of multiple computer networks, both similar and dissimilar, by means of gateways or routers that facilitate data transfer and conversion from various networks. A well-known abbreviation for the term internetwork is "internet." As currently understood, the capitalized term "Internet" refers to the collection of networks and routers that use the Internet Protocol ("IP"), along with higher-level protocols, such as the Transmission Control Protocol ("TCP") or the Uniform Datagram Packet ("UDP") protocol, to communicate with one another.

In addition to improvements in communications, recent developments in display technologies and electronic components now allow certain types of thin, flexible, and/or lightweight circuits suitable for displaying images and text. For example, various forms of electrophoretic displays (e.g., e-paper, e-ink, color e-ink and the like) provide non-volatile display technologies that may be used to form images on a display surface that does not change, even when not connected to a power supply (or in some forms they only require a relatively small amount of power to display an image). Likewise, new forms of liquid crystal display ("LCD") panels may be produced as flexible panels that can display color images (some electrophoretic displays cannot display color).

In addition to display technologies, numerous improvements in power technology now allow for thin and/or flexible batteries and other power sources (e.g., photo voltaic, ambient, radio frequency and the like). However, these display and power technologies have yet to be applied to the gaming and trading card arenas.

DETAILED DESCRIPTION

Figure 1:
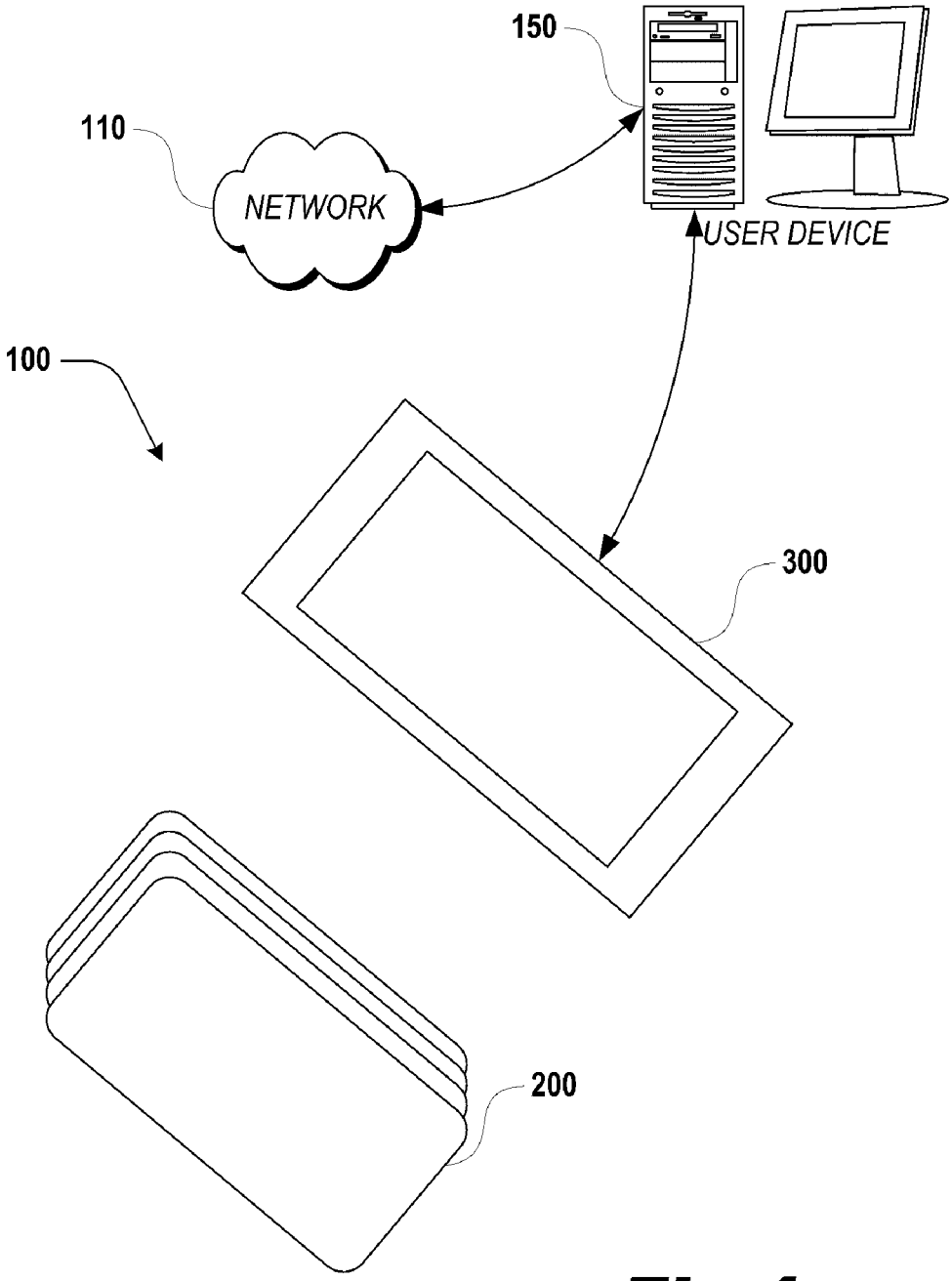
FIG. 1 is a pictorial diagram of a number of interconnected devices that provide a dynamic card functionality in accordance with various embodiments.

The detailed description that follows is represented largely in terms of processes and symbolic representations of operations by conventional computer components, including a processor, memory storage devices for the processor, connected display devices and input devices. Furthermore, these processes and operations may utilize conventional computer components in a heterogeneous distributed computing environment, including remote file Servers, computer Servers and memory storage devices. Each of these conventional distributed computing components is accessible by the processor via a communication network.

Reference is now made in detail to the description of the embodiments as illustrated in the drawings. While embodiments are described in connection with the drawings and related descriptions, there is no intent to limit the scope to the embodiments disclosed herein. On the contrary, the intent is to cover all alternatives, modifications and equivalents. In alternate embodiments, additional devices, or combinations of illustrated devices, may be added to or combined without limiting the scope to the embodiments disclosed herein.

Dynamic entertainment cards address many of the issues presented by conventional static entertainment cards (e.g., conventional playing cards, fantasy trading cards, collectable cards and the like). To show the operations of dynamic cards, FIG. 1 illustrates an exemplary dynamic card system 100 having a number of devices used in exemplary embodiments. FIG. 1 illustrates dynamic cards 200 (illustrated in FIG. 2 and described below), and a network 110, such as a wired or wireless communications network. Also in communication with the network 110 is a user device 150 (such as a personal computer, mobile phone, personal data assistant, laptop computer, or other user device), and a card base 300 (illustrated in FIG. 3 and described below). In alternate embodiments, there may be more dynamic cards 200, card bases 300 and/or user devices 150. In further embodiments, the roles of one or more of dynamic cards 200, card base 300 and/or user device 150 may be performed by an integrated device (not shown) or may be distributed across multiple other devices (not shown). In still further embodiments, still additional devices (not shown) may be utilized in the dynamic card system 100.

Figure 2:
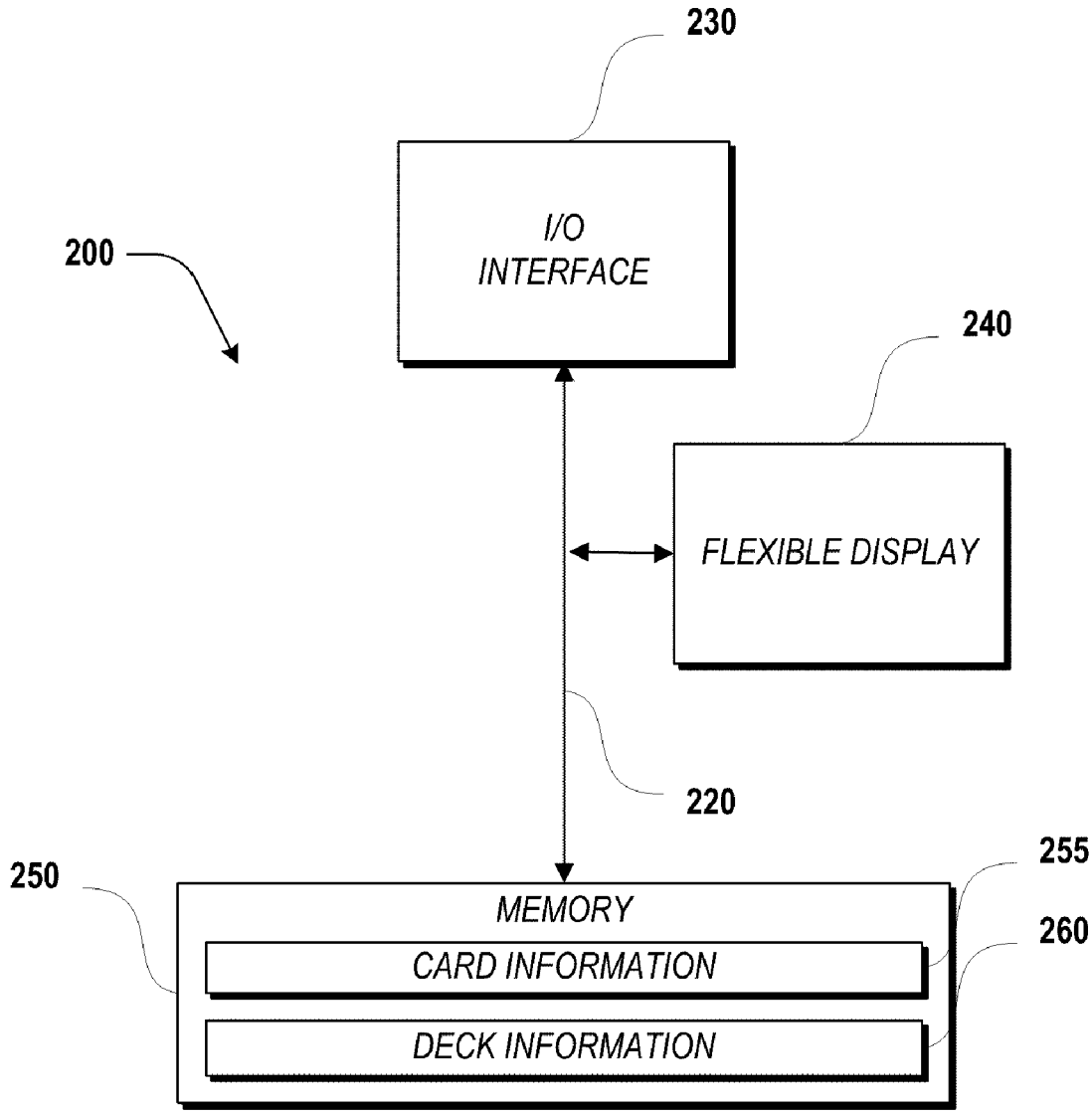
FIG. 2 is a block diagram of a simple dynamic card that provides an exemplary operating environment for one embodiment.

FIG. 2 illustrates several components of a simple dynamic card 200 ("SDC"). In some embodiments, the SDC 200 may include many more components than those shown in FIG. 2. However, it is not necessary that all of these generally conventional components be shown in order to disclose an illustrative embodiment. As shown in FIG. 2, an SDC 200 may include an input/output interface 230 for connecting to the other devices (e.g., other SDCs 200, card base 300, or the like). Those of ordinary skill in the art will appreciate that the input/output interface 230 includes the necessary circuitry for such a connection and is constructed for use with the appropriate protocol(s).

The SDC 200 may also include a processing unit (not shown), a memory 250 and a flexible display 240 (such as a flexible electrophoretic or LCD display), all interconnected along with the input/output interface 230 via a bus 220. The memory 250 generally comprises one or more of a random access memory ("RAM"), a read only memory ("ROM"), flash memory, display memory (e.g., as part of flexible display 240) and a permanent mass storage device, such as a disk drive, flash memory, or the like. The memory 250 stores card information 255 and optionally deck information 260. It will be appreciated that these software components may be loaded from a computer readable medium into memory 250 of the SDC 200 using a memory mechanism (not shown) associated with a computer readable medium, such as a floppy disc, tape, DVD/CD-ROM drive, memory card, the input/output interface 230 or the like.

Although an exemplary SDC 200 has been described that generally conforms to simple general purpose computing device, those of ordinary skill in the art will appreciate that a SDC 200 may be any of a great number of devices capable of communicating with the card base 300 and displaying card information.

Figure 3:
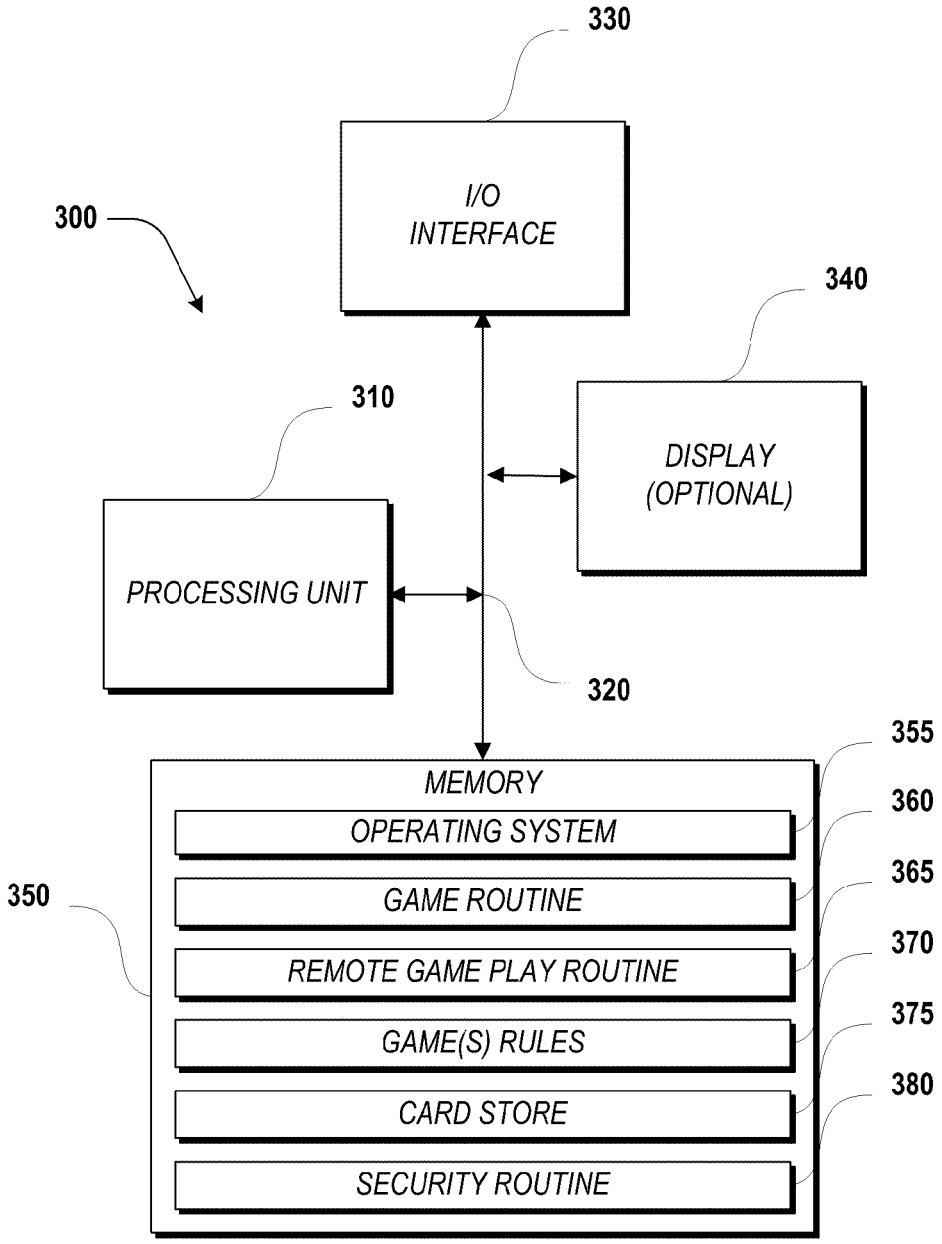
FIG. 3 is a block diagram of a card base that provides an exemplary operating environment for one embodiment.

FIG. 3 illustrates several components of the dynamic card base 300. In some embodiments, the card base 300 may include many more components than those shown in FIG. 3. However, it is not necessary that all of these generally conventional components be shown in order to disclose an illustrative embodiment. As shown in FIG. 3, the card base 300 includes an input/output interface 330 (e.g., for connecting to the network 110 or to one or more cards 200). Those of ordinary skill in the art will appreciate that the input/output interface 330 includes the necessary circuitry for such a connection and is constructed for use with an appropriate protocol.

The card base 300 also includes a processing unit 310, a memory 350, and may include an optional display 340 (or visual/audio indicators), all interconnected along with the input/output interface 330 via a bus 320. The memory 350 generally comprises a RAM, a ROM, flash memory, and a permanent mass storage device, such as a disk drive. The memory 350 stores program code for a game routine 360, in addition to a remote gameplay routine 365, game rules 370, card storage 375, and a security routine 380. In addition, the memory 350 also stores an operating system 355. It will be appreciated that these software components may be loaded from a computer readable medium into memory 350 of the card base 300 using a memory mechanism (not shown) associated with a computer readable medium, such as a floppy disc, tape, DVD/CD-ROM drive, memory card, the input/output interface 330 or the like.

Although an exemplary card base 300 has been described that generally conforms to conventional general purpose computing devices, those of ordinary skill in the art will appreciate that a card base 300 may be any of a great number of devices capable of communicating with dynamic cards 200, the network 110 or with a user device 150.

Figure 4:
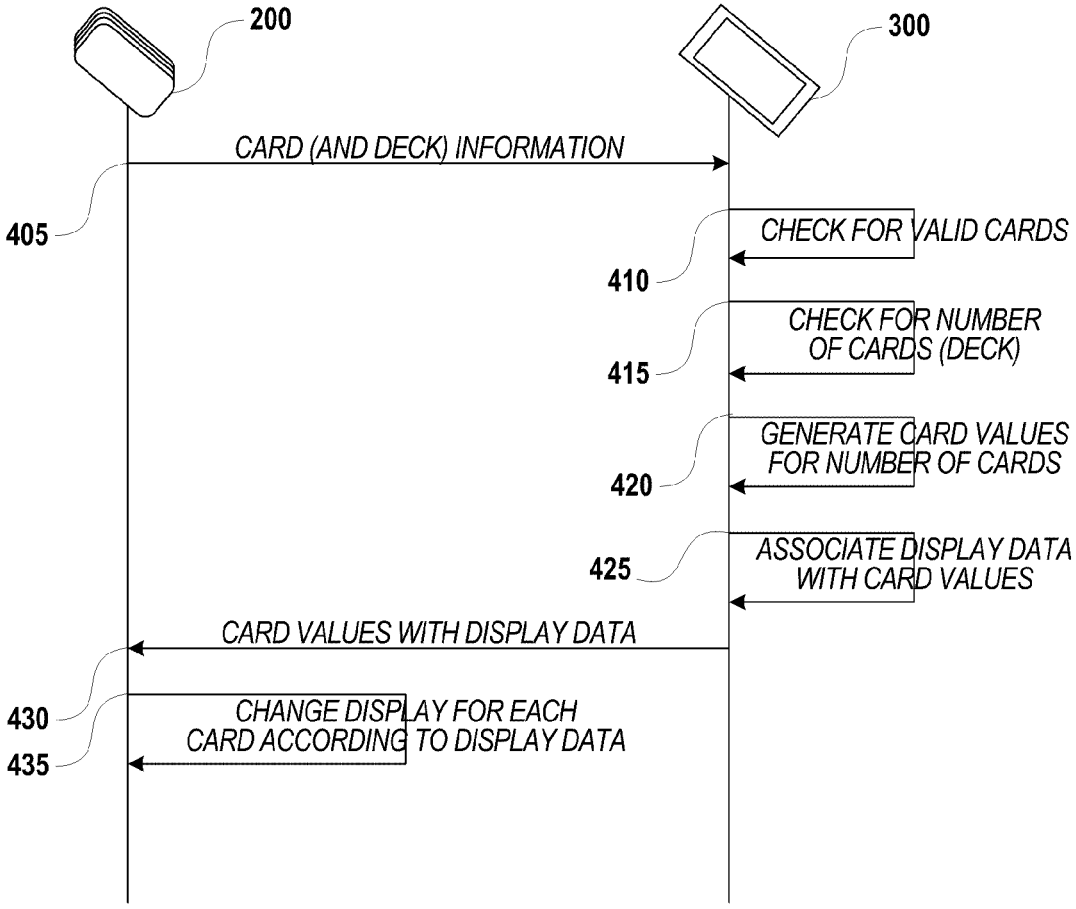
FIG. 4 is a diagram illustrating the actions taken by devices in a simple dynamic card system for processing a card display defining transaction in accordance with one embodiment.
Figure 5:
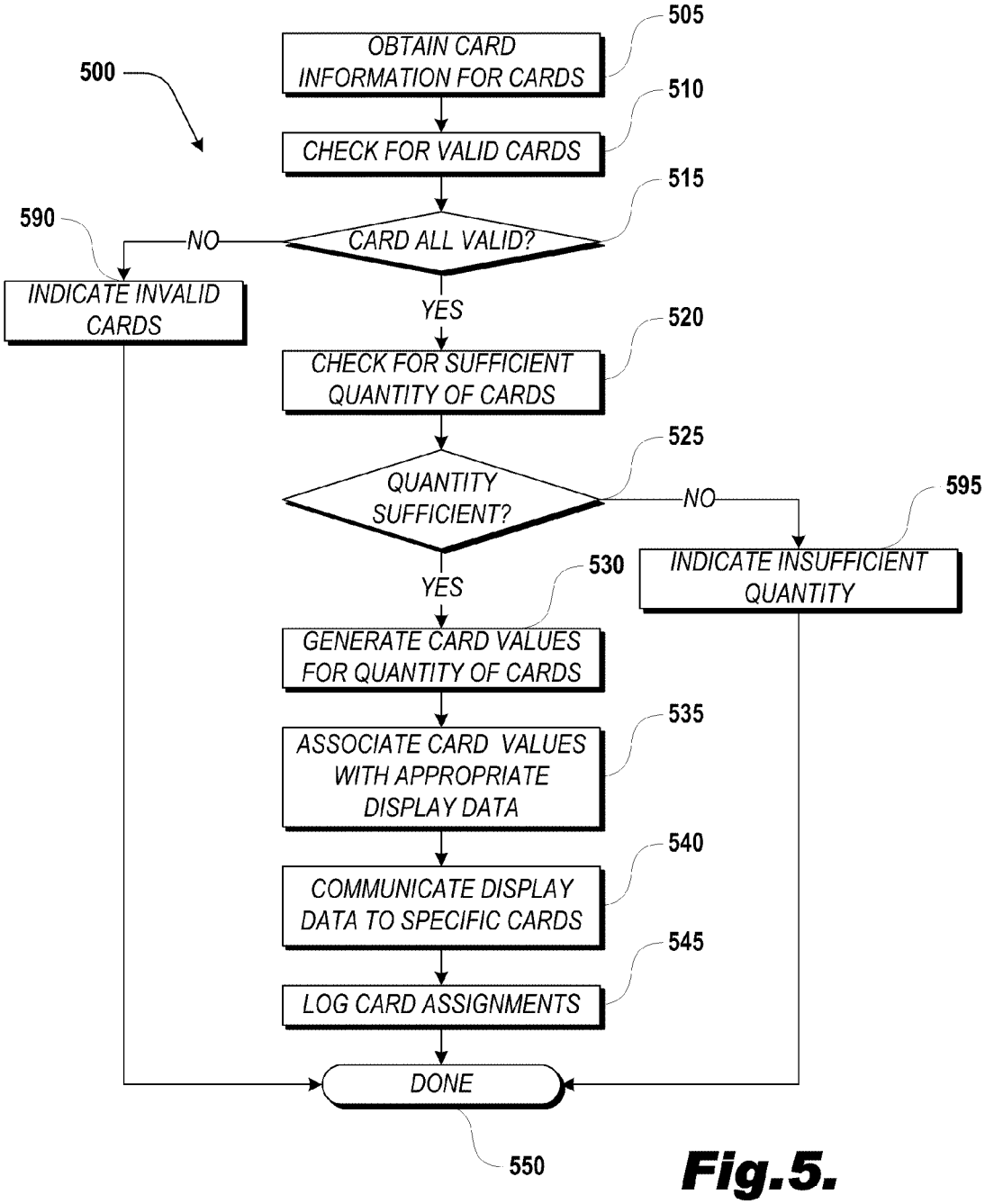
FIG. 5 is a flow diagram illustrating a card display defining routine in accordance with one embodiment.

FIGS. 4-5 illustrate exemplary steps to set up a deck of SDC 200 in an exemplary dynamic card system 100. Some transactions in the system 100 may be more or differently networked than others. Accordingly, in some embodiments, the number and types of devices may vary.

FIG. 4 represents an exemplary, simple dynamic card system interacting with a base station 300. The base station 300 may provide some of the processes and "intelligence" for setting the appearance of the simple dynamic cards 200. In FIG. 4 the interaction between the cards 200 and the base 300 are illustrated as communication transactions. One exemplary illustrated transaction begins with card (and card deck) information being sent 405 from the simple dynamic cards 200 to the base 350.

In one exemplary embodiment, sending 405 card information may be accomplished simply by placing the cards 200 onto the base 300. In an alternate embodiment where the base has a box or card carrier form factor, sending card and/or deck information may comprise placing the cards within the base 300. In still further embodiments, communication between the cards 200 and the base 300 may be accomplished by any type of data communication (such as wireless and/or communication over/through conductive materials). Once the base 300 has the card information, the base checks 410 for valid cards. In some embodiments, checking for valid cards may comprise determining if the cards 200 are of an appropriate type for use with the base 300. In other embodiments checking for valid cards may comprise checking the cards have not been damaged.

The base checks 415 for an appropriate number of cards. In various types of card games, the actual number of cards used may be both more or less than the number of cards in a single deck. If the base 300 has been designated to supply cards for a particular type of game, it will be able to determine if there are a sufficient number of cards for use by the players. For example, in a "Heads-Up" game of "Texas Hold'em" Poker, the number of cards that are actually revealed during a game is nine cards. Each player would receive two cards and there would be five shared cards on the table. In some variations of Texas Hold'em, game cards may be discarded during the deal, however, they would not be revealed at any point during game play. Accordingly, in a Heads-Up game of Texas Hold'em the total number of physical cards that are needed for there to be proper game play is only nine cards. Therefore, when the base 300 checks for an appropriate number of cards, only nine cards would need to be present in communication with the base 300 for this type of game. Note, however, that while only nine cards may be physically present, when generating values to be assigned to the cards 200 or determining which values should be assigned to the cards, a whole deck of cards may be determined in the base's memory 350. For example, when the base 300 generates 420 card values for the number of cards, the card values are generated in many embodiments by a "shuffled" deck of appropriate cards. While a conventional deck of fifty-two playing cards with thirteen each of clubs, hearts, spades and diamonds may be employed, in other embodiments, other types of cards may be used, for example Tarot cards, Mahjong sets, Japanese flower cards, Scrabble® tiles and the like.

Once the base 300 has generated 420 card values for the appropriate number of cards that will be used in the game, those values are associated 425 with display data for the cards. The base 300 will then communicate 430 the card values with the display data back to the cards 200. The cards 200 are changed 435 to display the appropriate display data for the value assigned to each card 200.

While exemplary communication with cards 200 and the base station 300 has been shown and described, further embodiments may "deal" cards in an unconventional manner corresponding to the dynamic nature of the cards 200. For example, in one embodiment, the physical cards 200 of the game are dealt out ahead of time to the players and are only revealed at appropriate points during the game. For example, initially the base 300 might wirelessly communicate the card values and display data to only those cards 200 that are in a player's hand. Later, as the game progresses, the base 300 may communicate card values and associated display data to cards 200 shared on a table as each round of a game progresses. Such games may be implemented with the base 300 having knowledge as to which physical cards 200 would be in a player's hand at a given point, or in an alternate embodiment, the base 300 may communicate with one or more other devices (e.g. a "smart felt" playing surface 1400 or a handheld device, not shown) that would communicate the location of the cards in proximity to a player back to the base station 300.

Additionally, some cards may be multifunction, so the same deck may be used for Poker and Pinochle. Jokers can appear or disappear based on the needs of the game. Extra cards can blink, make noise, or go blank so they can be removed from the deck.

In some embodiments, cards in the player's hand may be able to reorder themselves. For example, in a game where the player has many cards in her hand, the cards would rearrange themselves in descending order to facilitate game play. Likewise, in games where players reorder cards to win such as Guillotine, the player can tap the card they want to move, and the cards reorder themselves instead of forcing the player to move them around manually.

To better illustrate the operation of the base 300, FIG. 5 illustrates an exemplary flow diagram for processing SDCs 200. Card processing routine 500 begins at block 505 where the base 300 obtains card information for cards 200. Next, in block 510, the validity of the cards is checked. In decision block 515, a determination is made whether the cards are all valid. If so, processing proceeds to block 520 where the quantity of cards is checked to determine if there is a correct number of cards 200 (e.g., by checking a predefined value or a user input value for the type of deck and/or game). If in block 525 it is determined that the quantity of cards is sufficient, processing proceeds to block 530. In block 530, card values are generated from the total possible card values and assigned to each of the physical cards 200. In block 535, the card values are associated with appropriate display data. In various embodiments the cards 200 may not have explicit values and may only have display data; accordingly, blocks 530 and 535 may be combined into a single action of associating dynamic content with each of the cards 200. In block 540 the display data is communicated to each of the cards 200 and the assigned display data for this "deal" is logged to a storage system (e.g., base memory 350 or a remote storage, not shown). Card processing routine 500 then ends at block 599.

Returning to decision block 515, if it was determined that one or more of the cards was not valid (e.g., wrong type, damaged, conflicts of another card, or the like), processing proceeds to block 590 where an indication that there are invalid cards is presented. In some embodiments the indication of invalid cards may be in explicit message to a user interface (e.g., indicating which card is invalid), while in other embodiments, an indicator (e.g., visual, audible or the like) may be used to indicate that one or more cards is invalid (e.g., a red LED, tone, or the like). Processing proceeds to block 599.

Likewise, if in decision block 525 it is determined that there is an incorrect quantity of cards, processing proceeds to block 595, where an indication that there is an incorrect quantity of cards is presented to a user of the base 300. In some embodiments the indication of incorrect quantity and indication of invalid card(s) may be combined into a single indication of an error (e.g., visual or audible indicator), while in other embodiments they may be separate indications. Processing proceeds to block 599.

In one example implementation described below, a deck of fifty-two dynamic cards 200 is capable of shuffling itself. This type of deck can be used in games in a fashion similar to a conventional deck of playing cards.

Each dynamic card 200 may be made of a flexible plastic. The front face is a dynamic display surface (e.g., electrophoretic display, LCD, or other thin display 240), while the rear surface is printed with conventional ink with a static decorative image (not shown). In some embodiments, the back may be a dynamic display as well.

The card is equipped with two rows of twenty-six contacts (not shown), one on the front and one on the back. The contacts are aligned such that if the cards are stacked one atop the other, each card will connect with the one below. The contacts may be continuous through the card, so any electrical signal sent to the leftmost contact of one card will be detectable on the leftmost contact of any other card placed on top of or beneath it.

The contacts supply power and display data, and allow the display surface on each card to be individually addressed, as follows:

Conventional cards come in decks of fifty-two cards. Each card has an address that is unique within its deck, from one to fifty-two. When that address is placed on the "Card Address" lines, the Address Decode logic (e.g., in memory 250) enables an electrophoretic display driver (not shown) for that card. Hereafter, a card will be referred to by its address. For example, "C1" will refer to the card whose display is modified when the address "1" is placed on its card address lines.

This example implementation may also use a "card shuffler" (such as base 300). This is a device that comfortably holds all fifty-two cards, and has contacts that mate with the bottommost card.

The shuffler may supply power to a card 200 placed on top of it through power contacts (not shown). Since each card's contacts may pass through to the back side, the entire deck of cards may be stacked on the shuffler and powered and addressed together.

By measuring the power draw of the cards using an A/D converter (not shown); it is possible to determine how many cards are attached and drawing power. In other implementations, individual card information may be accessed to count the cards.

If some number of cards other than fifty-two is attached, an LED indicator may remain unlit. However, in one implementation, if fifty-two cards are placed on the base 300, the following sequence is executed:

(1) An LED indicator turns red.

(2) A processor (e.g., processor 310) creates an array (not shown) in memory 350 containing a representation of a standard deck of fifty-two cards, in arbitrary order.

(3) The processor 310 uses a shuffling algorithm to randomize the arrangement of the deck of cards in memory 350.

(4) The processor 310 places the address of C1 on the "Card Address" output lines.

(5) The processor 310 reads the card assignment for C1 from the randomized deck now stored in memory, for example, the "king of hearts."

(6) The processor 310 looks up a digital stored image (e.g., from card storage 375) that corresponds to the chosen card, in this case, an image of the king of hearts.

(7) The processor 310 updates the display of C1 with the chosen image by sending the appropriate commands over the display data lines. Note that cards C2-C52 also receive the update information, but since their addresses are not present on the address lines, they do not update their displays.

(8) Steps 4-7 are repeated, replacing C1 with C2-C52 in the address lines.

(9) The LED indicator turns green.

From the player's perspective, she will have a deck of conventional playing cards with images on the front (and/or back). These cards are static and can be used conventionally. When it is time to shuffle, she will place the deck of cards down on the shuffler and press down to ensure contact between all cards. The light will turn red for a moment, and then turn green. When it turns green she can remove the cards from the shuffler. Exemplary electrophoretic display faces of the cards may still appear to be cards of a conventional deck, but will have changed to be in random order—effectively shuffled. With power removed, the electrophoretic displays remain constant indefinitely, and the cards can be used like conventional playing cards.

In further embodiments, the changing of card values may happen wirelessly. Additionally, if a base 300 is made aware of game rules and is aware of card placement, it may be possible to automatically shuffle all cards once it is determined that all cards are face down on a playing surface (e.g., through the use of sensors or other switching circuits).

Figure 6:
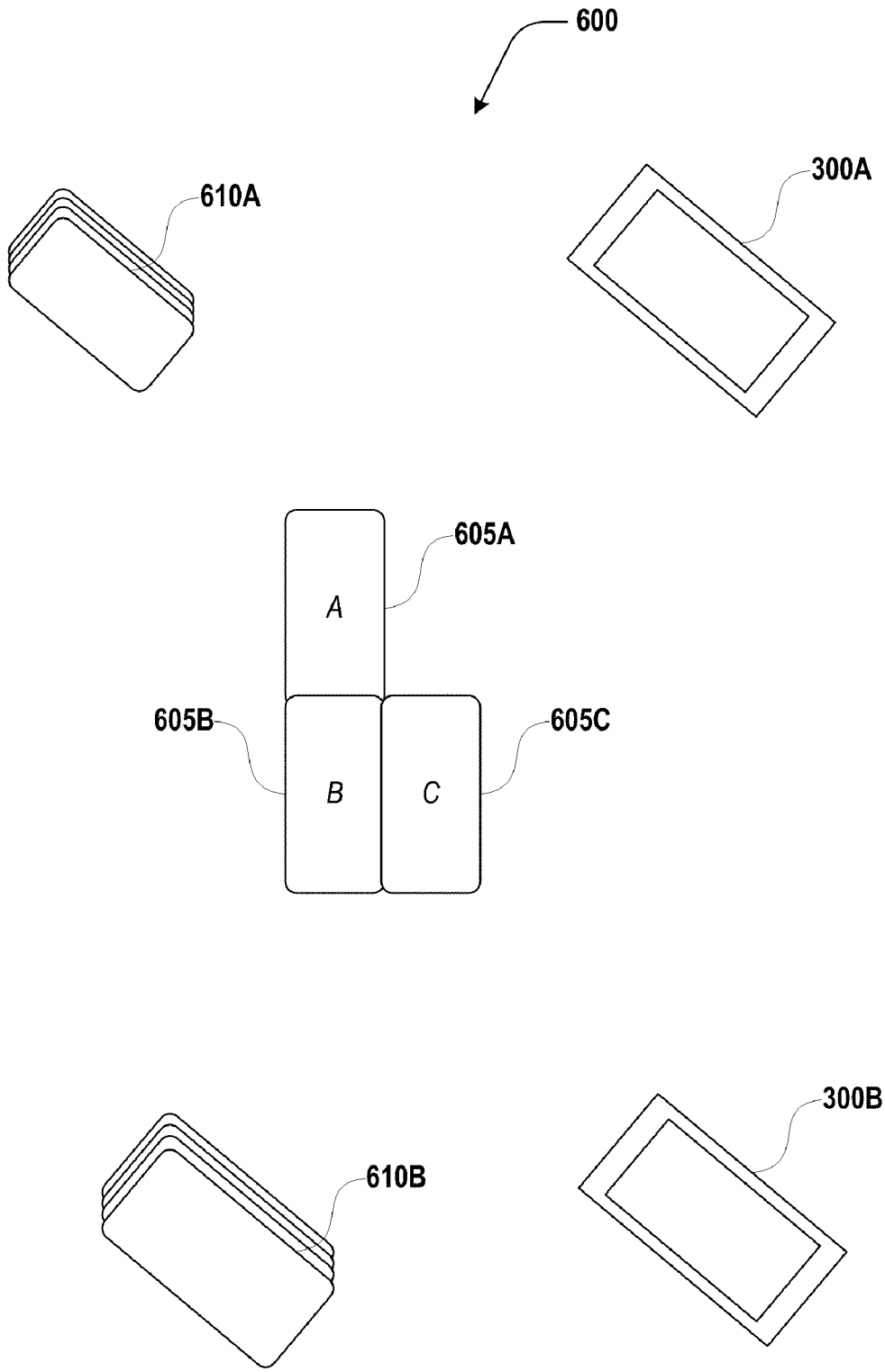
FIG. 6 is a pictorial diagram of an example card game layout in accordance with one embodiment.

FIG. 6 illustrates an exemplary embodiment with multiple decks of cards 610A, 610B and multiple bases 300A, 300B where complex dynamic cards 605A, 605B and 605C ("CDC") are used in an interactive manner. Generally, an interactive card game would involve two or more players; each player having at least one deck and one card case/base 300. In an embodiment using a card case, the card cases 300A, 300B may act as intelligent storage mechanisms that hold all of the CDCs owned by the player.

In one embodiment, cards stored in a card case 300A-B may be equal to the number of physical cards owned by the player. In alternate embodiments there may be more or fewer cards stored in the card case 300A, 300B than the number of physical cards within the case 300A-B. The physical cards 605A-C may actually be small devices upon which card values rules and interactive instructions may be loaded. Accordingly, there may be loaded and/or blank cards within the card case 300A-B of a player. Likewise, there may be more "virtual" cards in the card case 300A-B than the number of loadable cards 605A-C that are actually present within the case 300.

In the example illustrated layout shown in FIG. 6, two players are playing a fantasy trading card game with a first player having a base 300A and a deck of cards 610A. This first player has played a first CDC 605A. The second player also has a deck 610B and a base 300B and has played CDC 605B along with a companion CDC 605C. Companion CDCs will be discussed in greater detail below. In the illustrated embodiment shown in FIG. 6, the cards 605A-C have rules for interacting with each other and have appropriate capabilities.

Good examples of static (i.e., conventional) fantasy trading card games include Pokemon® cards from Nintendo Corporation of Japan, Magic The Gathering® Cards of Wizards of the Coast, Inc., of Renton, Wash., and the like. In such games, a player may use cards to build scenarios in a competitive manner. For example, if a card representing a creature is set up by one player against a card representing another form of creature, the respective rules and capabilities of each card would be compared and then a winner of that turn may be determined. In some embodiments, the use of dynamic cards may provide a more desirable environment in which to make use of fantasy trading cards. For example, if two cards that have creatures on them are placed so that they may interact, the visual imagery on the cards may be modified to show a still or animated representation of the creatures interacting. However, cards may have simply decorative animations as well.

In some embodiments, cards may collaborate to display information. An object can be shown moving from one card to another, or cards that are lined up can work together to present a large, unified display surface. Also, cards may support a "display" or "browse" mode. For example, cards may render a flashy image with less information presented when placed in an album.

Alternately, cards may contain fragmentary or redundant information that is only utilized when other cards are present. For example, each card in a group may have a segment of a video, and when all cards in the set are collected, the entire video can be played.

In still further embodiments, various dynamic cards can be used in conjunction with conventional cards or game pieces in the same game. For example, each player might have a "tally card" in a poker game that tracks game play. A trivia game might have conventional cards with "fixed trivia" and indistinguishable electrophoretic display cards with "digital trivia" questions that can change over the course of the game.

Figure 7:
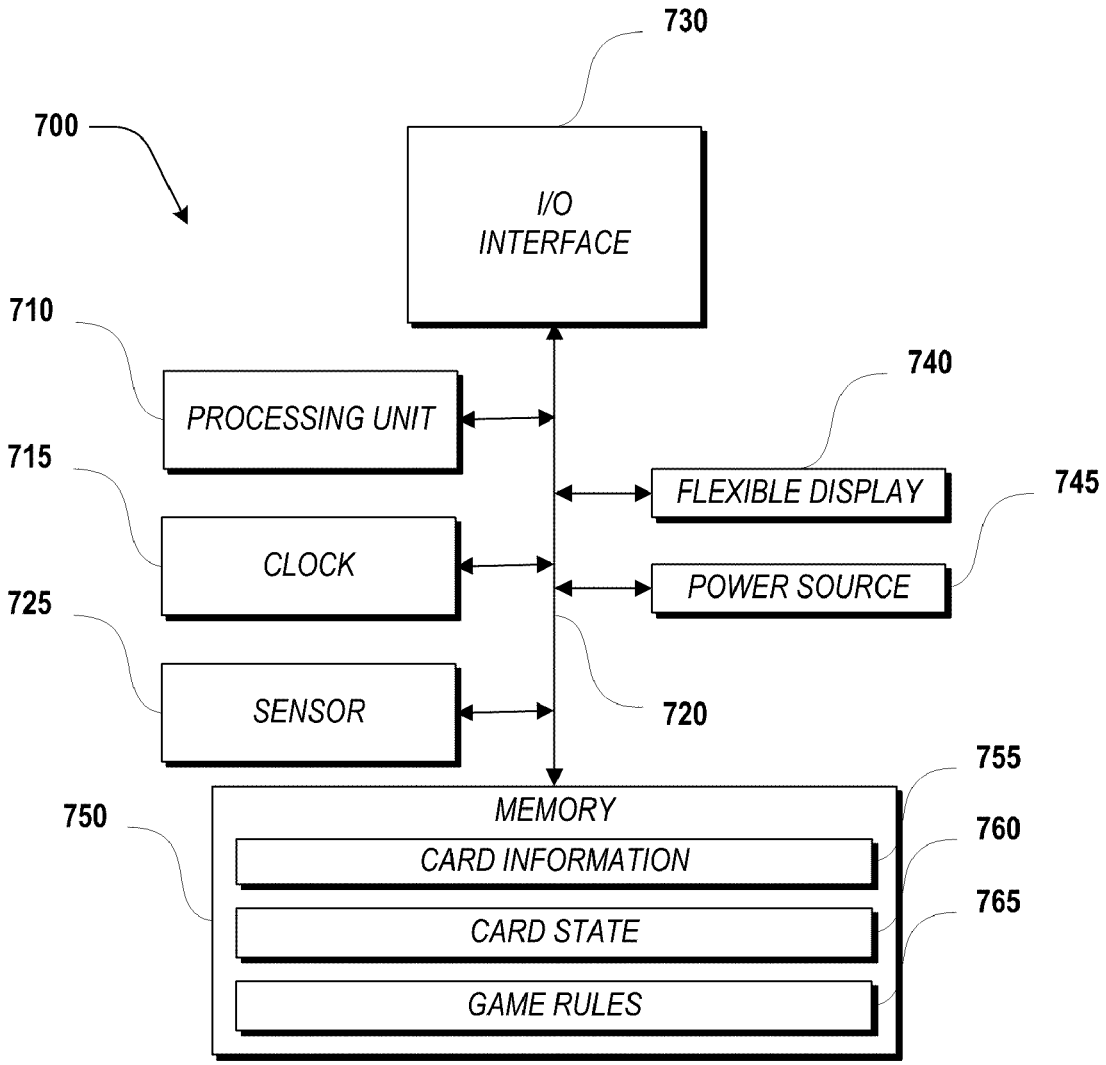
FIG. 7 is a block diagram of a complex dynamic card that provides an exemplary operating environment for one embodiment.

FIG. 7 illustrates several components of a CDC 700. In some embodiments, the CDC 700 may include many more components than those shown in FIG. 7. However, it is not necessary that all of these generally conventional components be shown in order to disclose an illustrative embodiment. As shown in FIG. 7, the CDC 700 includes an input/output interface 730 for connecting to the other devices (e.g., other CDCs 700, card base 300, or the like). Those of ordinary skill in the art will appreciate that the input/output interface 730 includes the necessary circuitry for such a connection and is constructed for use with the appropriate protocol(s).

The CDC 700 may also include a processing unit 710, a memory 750, a flexible display 740, a clock 715, a sensor 725 and a power source 745, all interconnected along with the input/output interface 730 via a bus 720. The memory 750 generally comprises one or more of a RAM, a ROM, flash memory, and a permanent mass storage device, such as a disk drive. The memory 750 stores card information 755, card state 760 optional deck information (not shown), and game rules 765. It will be appreciated that these software components may be loaded from a computer readable medium into memory 750 of the CDC 700 using a memory mechanism (not shown) associated with a computer readable medium, such as a floppy disc, tape, DVD/CD-ROM drive, memory card, via the input/output interface 730 or the like.

Some non-limiting examples of sensors 725 include light sensors, GPS units, compasses, microphones, switches, accelerometer, motion sensors, magnets, radiation detectors, airflow sensors, orientation sensors, contact sensors, thermometers and the like.

In one exemplary embodiment, a sensor 725 may detect whether a card is "face up"/"face down" and how it is oriented (e.g., "upside down"/"right-side up") relative to the player playing the card 700. Detecting such an orientation, may cause a change in the game play and/or rules that affect the playing of the card.

In another example, cards may sense their relative positions. For example, a "fighter" card to the right of a 'plant' card may represent a fighter that controls plants, while a fighter card to the left of a plant card may represent a plant with fighting capabilities.

In some embodiments, the clock 715 may be selected from the variety of absolute or relative time tracking and/or event tracking devices. Such time/event tracking devices may include time and date tracking for an absolute time and/or date, while in other embodiments the clock 715 may simply provide a relative time since a given point in time (e.g., from an arbitrary point, from a card creation or the like). In various other embodiments, the clock 715 may track actions or events and their orders.

In various embodiments, cards may evolve over the course of game play. In some embodiments they may then reset at a game end at other times they may evolve over multiple games. For example, in a real estate trading game, rents indicated on the card might increase slowly over the course of the game, then be reset at the conclusion of the game.

In some embodiments, an action may result in a player or card gaining points of some kind and the card 700 may track these points as well (in the clock 715 or elsewhere, such as in the memory 750). Accordingly cards may become more powerful as they are used more often (i.e., as they gain more points from their use). In further embodiments, actions may be qualitatively ranked such that some actions may generate greater point values and corresponding may gain more points for a player. For example, a skillful use of a card, or a relatively weak card (or card combination) used to defeat a stronger card (or card combination) may generate "bonus" or increase points.

In various embodiments, some cards may produce other sensory responses other than a visual response. For example, a card 700 may have a haptic response or may generate a sound in response to card play. In one specific non-limiting example, each card in a deck can produce a separate tone. Laying the cards out in order could produce a song. As in other embodiments, additional cards could be added to vary the sounds. In one specific example, a C# Card could be combined with a companion Trumpet Card to produce a C# tone from a simulated trumpet. Likewise, cards may produce sound effects relevant to the game (e.g., according to game rules 765). For example, they might play "background music" or make a "cha-ching" sound when a player wins a hand.

In another embodiment, cards 700 may be used as writing or drawing surfaces (e.g., by having many fine touch-sensitive pixels, possibly coupled with display pixels). For example, in a picture-guessing game, the players might draw their pictures on a "card" or sheet each turn. A card would erase itself after the turn was complete.

Additionally, cards may have "bonus" functionality unrelated to their core functionality. For example, a standard card deck may also function as a calculator.

It other variations, game rules 765 can be automatically processed and reflected in cards. For example, in a war simulation game, a soldier card might indicate which territories it could be deployed on, according to a complex set of rules 765. In solitaire, possible valid locations for placing a card 700 might blink.

Some exemplary embodiments may have cards with Game Rules 765. In further embodiments, the cards may enforce the Game Rules 765. For example, if "Dominos" cards are improperly placed, the display 740 may blink or otherwise indicate that a placement was against the rules. In other games, breaking a rule might even exact a penalty against a player score.

Similarly, if a card was misdealt or a player accidentally revealed their cards, it maybe possible to deal the cards again or otherwise respond to the breaking of the rules.

Although an exemplary CDC 700 has been described that generally conforms to conventional general-purpose computing devices, those of ordinary skill in the art will appreciate that a CDC 700 may be any of a great number of devices capable of communicating with the card base 300.

In an exemplary game involving simulated combat, it may be possible to illustrate damage caused from interactions with one player's card to the other player's card(s) as part of the visual imagery on the cards (as well as a corresponding change in the abilities, points, characteristics and/or instructions related to the card that has been damaged). In other embodiments, other forms of state changes (reflected in a card state 760) may be implemented based on the use of cards 700. The state changes will be discussed in greater detail below.

In one specific form of combatant card usage, cards may be "conquered" from another player. For example, in a game where one card "beats" another card, the winner would capture the ownership of the loser's card. FIG. 7 illustrates an exemplary, complex dynamic card device and within the card there is a card state 760 portion of the card memory 750. The card state 760 may include ownership information indicating which player owns the card. Accordingly upon vanquishing a loser, the owner's card may transfer in indication of its ownership state to the losing card, thereby transferring the ownership from the losing player to the winning player.

In further embodiments, a record of cards maybe maintained, optionally with ownership information that may be used to verify cards as well as chain of title information. Such a record could be at a local device or via a remote database or the like.

In some games, ownership information may be transferred as part of game play. The ownership information may be recorded by the cards, a remote device or both.

In one exemplary embodiment, cards that belong to one player were all turned a uniform color once game play has finished, while cards belonging to another player would turn another color.

Some exemplary cards may have their use limited. As noted above, some cards may be unusable unless played by their owner (e.g., identified via a token, biometric information, location, private information or the like). Other kinds of cards may have only a limited number of "plays" available to them (e.g., a wand of fireballs; a wand of fireballs card may only have five charges) or must be used within a limited period of time.

Accordingly, it is appropriate for some (or all) cards to keep a history of their actions. The cards may use such a history to keep statistics on how each card has performed during game play. Likewise, the cards may provide an audit trail if any game play is suspicious. Periodically the history, statistics and/or audit trail may be backed up, cleared, truncated or the like.

In a similar fashion, cards may be combined. For example, a companion "skill" card can be added to an "actor" card to enhance a skill of the actor. In a very specific example, a named actor card "Ullrich" is placed on the playing surface. Next, a "broadsword skill enhancement" card is laid next to, and in contact with, the Ullrich card. The broadsword skill enhancement data is transferred to the Ullrich card to create a combined card. The card state 760 of the Ullrich card is updated according to the instructions and characteristics of the broadsword skill card.

Furthermore, in some embodiments the broadsword companion skill card may include instructions indicating that it may be used only a single time. Accordingly, after interacting with the Ullrich card, the broadsword companion skill card may be expected to delete its own data, or, at the least, delete the instructions and characteristics that would allow it to modify other cards.

In some embodiments the combination of cards may be reversible. For example, if an actor card (e.g., the Ullrich card) is combined with a companion skill card to "equip" the actor with some article, the reverse might be true as well. In other words, at a later point the equipment might be selected on the actor card to be transferred to another card, in effect de-combining the two cards. Such combinations and de-combinations may take place during card play, or outside the normal course of card game play.

In further embodiments, players may create card data from scratch. For example, there may be a "wild" (or blank) card in a fantasy game that can be loaded with data representing a monster of the user's design. In further embodiments, interactions between two or more cards may "spawn" new card data that could be contained in such a wild card.

Figure 8:
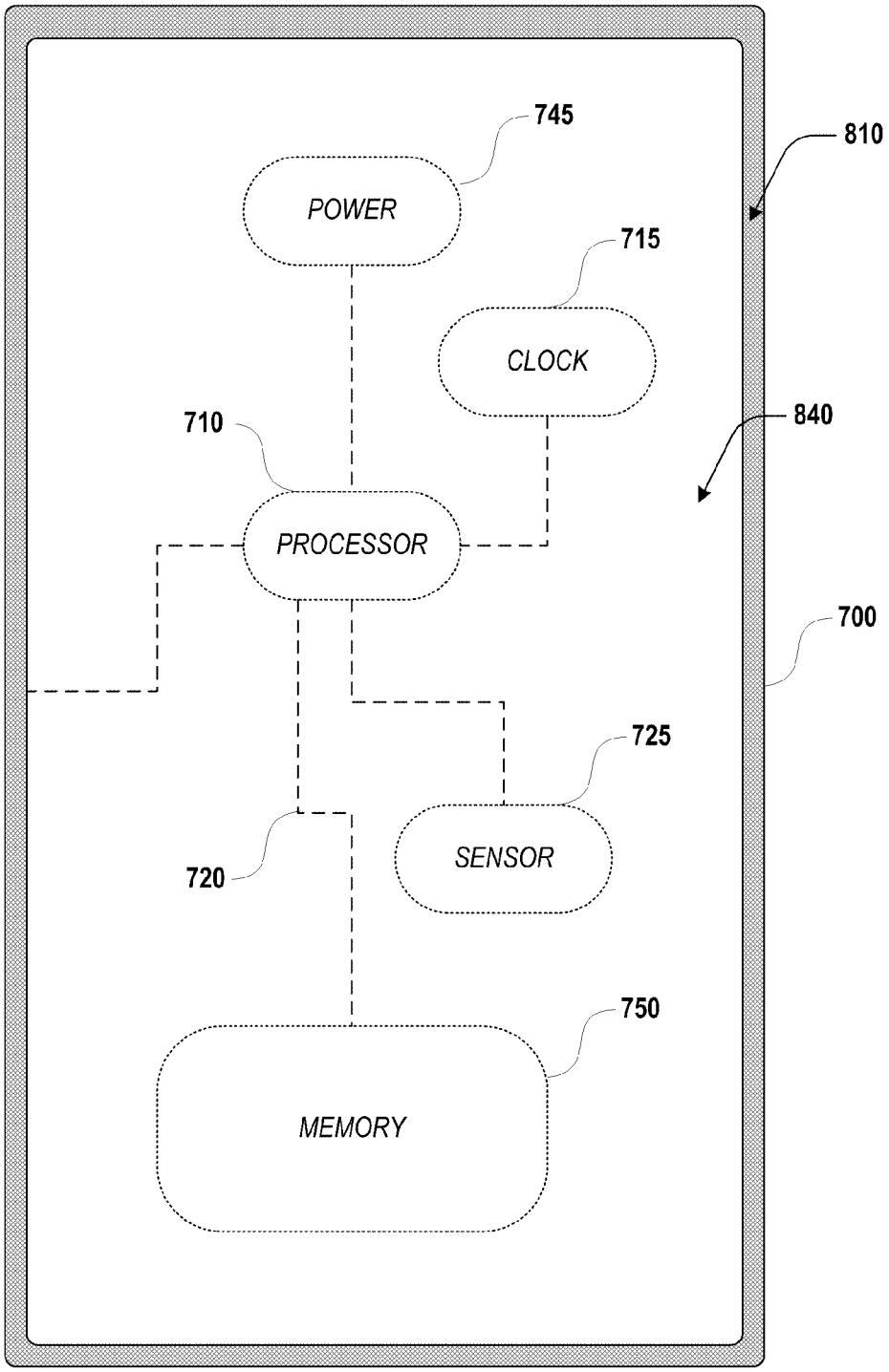
FIG. 8 is a pictorial diagram of an example dynamic card layout in accordance with one embodiment.

FIG. 8 illustrates another view of an exemplary complex dynamic card in accordance with various embodiments. The card 700 includes those components shown in FIG. 7 laid out in an example circuit layout. The processor 710 is connected to the memory 750 via the bus 720 and may also be connected either on the same bus 720 or via separate buses (not shown) to an input/output interface 730, a power source 745, a clock 715, a sensor 725, as well as a communication medium 810. The communication medium 810 may be a conductive surface suitable for communicating information between a plurality of cards. Suitable communication mediums may include metallic contact points, conductive layers, conductive substrates, touch sensitive components, light sensitive components, radio frequency sensitive circuitry and the like. All these components are laid out on a substrate 840 of the card 700. In some embodiments, either more or fewer components may be included in the complex dynamic card 700.

In still further embodiments alternate shapes of cards may be employed. For example, curved shapes as well as other regular and irregular polygon shapes may be employed when creating complex dynamic cards 700.

Figure 9:
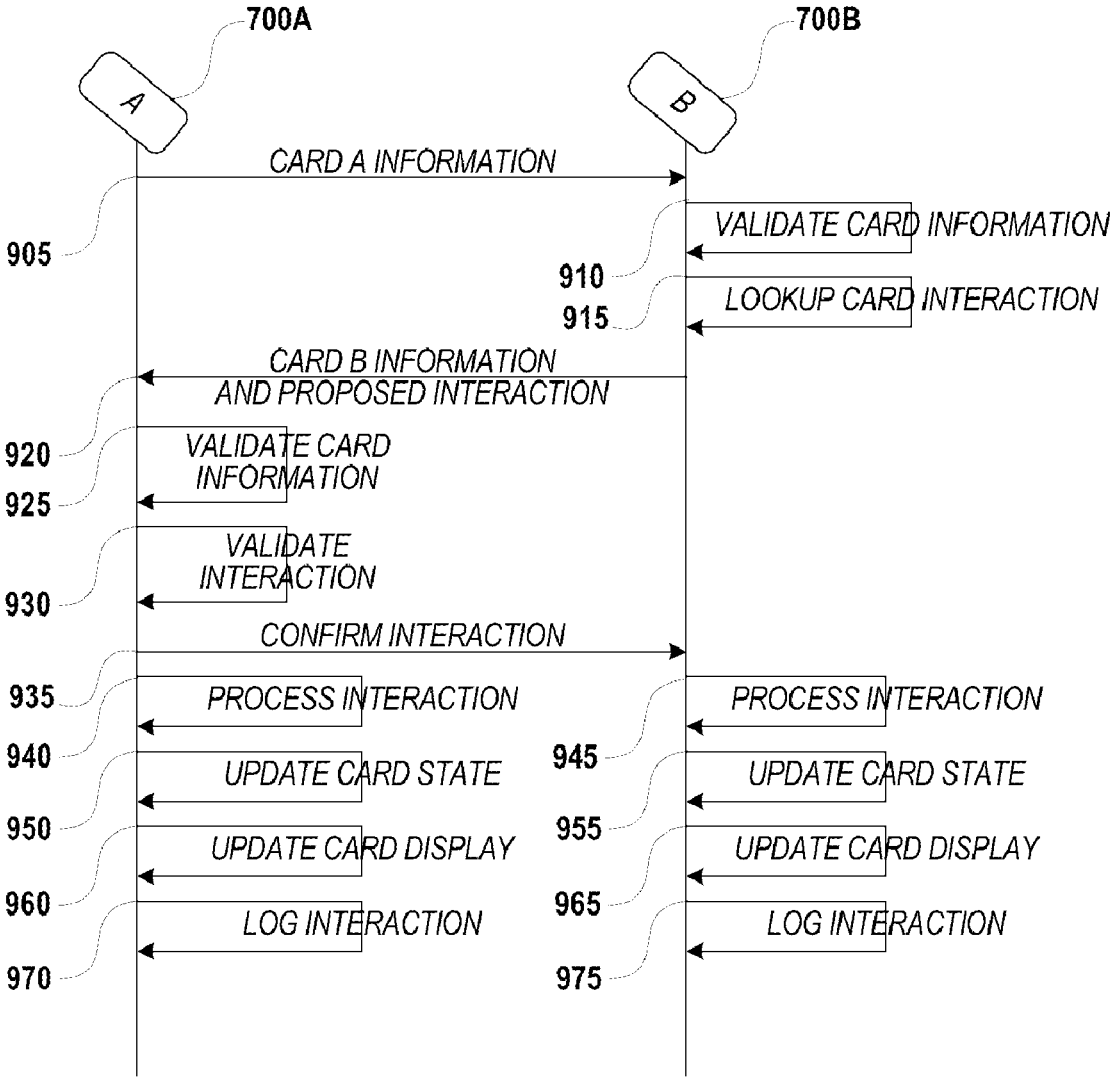
FIG. 9 is a diagram illustrating actions taken between dynamic cards in accordance with one embodiment.

FIG. 9 illustrates an exemplary interaction between two cards (Card A 700A and Card B 700B). While the interactions shown and described with regard to FIG. 9 includes a number of actions and communications at both Card A 700A and Card B 700B, in further embodiments, additional (and possibly different) actions may be performed to have complex dynamic cards 700A-B interact with each other. In exemplary embodiments, the interactions between cards A and B 700A-700B begin with Card A 700A communicating 905 Card A information to Card B 700B. Card B 700B validates 910 the received card information and looks up 915 an appropriate card interaction for Card A 700A. Card B 700B sends 920 Card B information and a proposed interaction to Card A 700A. Likewise, Card A 700A will validate 925 the received card information and will look up and validate 930 the proposed interaction to see if it conforms to its rules 765 and/or instructions for the interaction with Card B 700B. Once the interaction has been validated, Card A 700A confirms 935 the interaction to Card B 700B. Each card 700A-B processes the interaction 940, 945. Updates the respective card state 950, 955. Updates 960, 965 the card display 960, 965 and logs 970, 975 the interaction 970, 975.

The above described actions between the cards are performed in a generally synchronous manner. In alternate embodiments, asynchronous communications may be used when using dynamic cards, and the protocols for such asynchronous communications would be changed accordingly.

To better illustrate an exemplary interaction, a simple playing card game interaction of the card game "war" can be used to show how cards might interact with each other. Two cards are laid down across from each other such that their communication mediums 810 are in contact. Assume that one card 700A is a king of hearts and the second card 700B is the jack of diamonds. Card A 700A (king of hearts) sends 905 its information across to the other card 700B, in this case it may be a numeric value (presumably the value of 13 as the value for a king card (and possibly suit information), in this case, the suit of the hearts). While suit information may not be necessary for this game, in other games suit information may be useful. Card B 700B (the jack of diamonds) validates 910 the card information (e.g., checks that the suit is of the types of suits that are being used in this game, that the card has communicated values within the bounds, and may additionally validate information as to the deck from which the cards were drawn as well as the type of card all of which may also be validated). Presumably, when playing a game where all cards are supposed to come from the same deck, (as in the game of "war") it would be desirable to validate that the card being played is from the same deck (i.e., to prevent cheating). Next, Card B 700B would look up the card interaction 915 based on the game rules 765 being applied. In this case, the game rules are fairly simple: compare the values of the two cards 700A-B and the card with the highest value wins the hand; after which, the winner collects the two cards that were played. One additional rule is that if the cards are of the same value that a play off is to be played to determine who wins the hand. In this case, the comparison between the jack with the value of eleven and the king with the value of thirteen indicates that the player with Card A 700A has won the hand. Next, Card B 700B would send 920 its information (e.g. card value, suit, deck, card type, and the like) back to Card A 700A. Card A 700A would then validate 925 the card information and validate the interaction 930.

In this case, Card A 700A would also make the determination that it has a higher value than Card B 700B and would agree that it had won the hand. It would then confirm 935 the interaction with Card B 700B; after which, each card would take appropriate interactive measures 940-975.

In this instance, an exemplary set of actions may include Card B 700B reassigning its possession to be that of the player who laid down Card A 700A, as well as possibly providing an indication that it had lost the hand, (e.g., indicating the word "loser" superimposed on the display of the card) and logging the transaction into the card and/or the player's history of interactions. Similarly, the winning card may also have a display and state change, such as a superimposed winner indication on the winning card.

Although the above description is a simple example, more complex embodiments employ similar interactions. For example, in a poker game it may be possible to lay down the hands of each player and automatically determine the winner of a hand based on all the cards interacting with each other such that cards that are in separate hands form groups that may then communicate with other groups of cards played within the game to form grouped card interactions. The appropriate game rules 765 would then rank the values of the hand and indicate a winner. In fact, some cards may disseminate real-world information. For example, the high scorer in a card game may receive a link to a web site that the player can use to enter their high score, or the card can communicate a coded value for the high score to automatically update a remote device.

Likewise, more specialized card games may be employed using specific rule based interactions between cards. For example, in fantasy trading card games, in some embodiments, it may be unfeasible to have a complete record of all possible combinations of cards and their interactions. However, cards may be given certain points, abilities and/or characteristics that when interpreted by other cards in the game allow them to interact in an automatic/dynamic manner.

In one such fantasy trading card game scenario, a magic spell Card A 700A is placed opposing a monster card, Card B 700B in simulated combat. Assume that Card A 700A is a representation of a spell for casting a cold-based ice storm spell that inflicts ten points of damage in general against opponents. Assume then that monster Card B 700B is a salamander monster that supposedly lives in a high temperature environment and is particularly susceptible to damage from cold-based weaponry and/or spells. Therefore, when interacting between the cold spell card 700A and the salamander monster card 700B, an example interaction might go as follows: the cold spell card 700A communicates 905 its card information to the salamander monster card 700B including that it is a ten point cold-based magic spell of the particular type of card from a particular type of deck associated with a particular player. The salamander monster card 700B receives this information and validates 910 the card information and looks up 915 to see if there is a particular reference to this ice storm spell card 700A. Finding no reference to this particular card 700A, the salamander monster card 700B looks up 915 the characteristics in its instructions and sees that it will receive ten points of damage out of its total life-points (e.g., twenty) and also notes that it is particularly susceptible to cold-based magic spells and therefore will receive two times the amount of damage normally afflicted to non-susceptible creatures. Therefore, the damage amount from the ice storm spell is increased to twenty points of damage (matching the total amount that could be received by the monster before it dies) and communicates 920 its information and the proposed interaction to Card A 700A. Note, in this case, the information may include that it is a salamander monster, that it is from particular deck owned by a particular player, it is of a particular type of card and the like; but, also, that the proposed interaction is that the salamander monster would die as a result of the ice storm card 700A being played. The ice storm spell card 700A validates 925 the salamander card's 700B information and validates the interaction 930 noting that the proposed interaction is proper under the circumstances. It may be that in some embodiments, the interaction would not be specified as the death of the salamander; rather, that the interaction would be an equation-like response, such as ten points of damage are received, ten points of damage are doubled because of cold-based susceptibility and the resulting total is subtracted from the remaining points of the monster (in this case twenty), therefore leaving zero points of damage left available to the monster. The ice storm spell card 700A would confirm 935 the interaction to the salamander monster card 700B, after which, each card would then process the interaction 940, 945, update the card's state 950, 955, update the card display 960, 965 and log the interaction 970, 975.

In various embodiments of this example, the ice storm spell card 700A might also communicate imagery to be used at the salamander monster card 700B. For example, it may appear that an ice storm spell would flow from one card display 740 to the other card's display 740. Likewise, once the salamander monster has died, the display of the card may be updated to indicate that the salamander monster is dead.

In still further embodiments, where fantasy trading card games are played for possession of cards, once certain criteria are met (e.g., when a monster card dies or the like) the ownership of a losing or dead character's card may be transferred from the loser to the winner.

In other embodiments further interactions may be performed between complex dynamic cards 700, those listed above are meant purely for non-limiting illustrative purposes.

Figure 10:
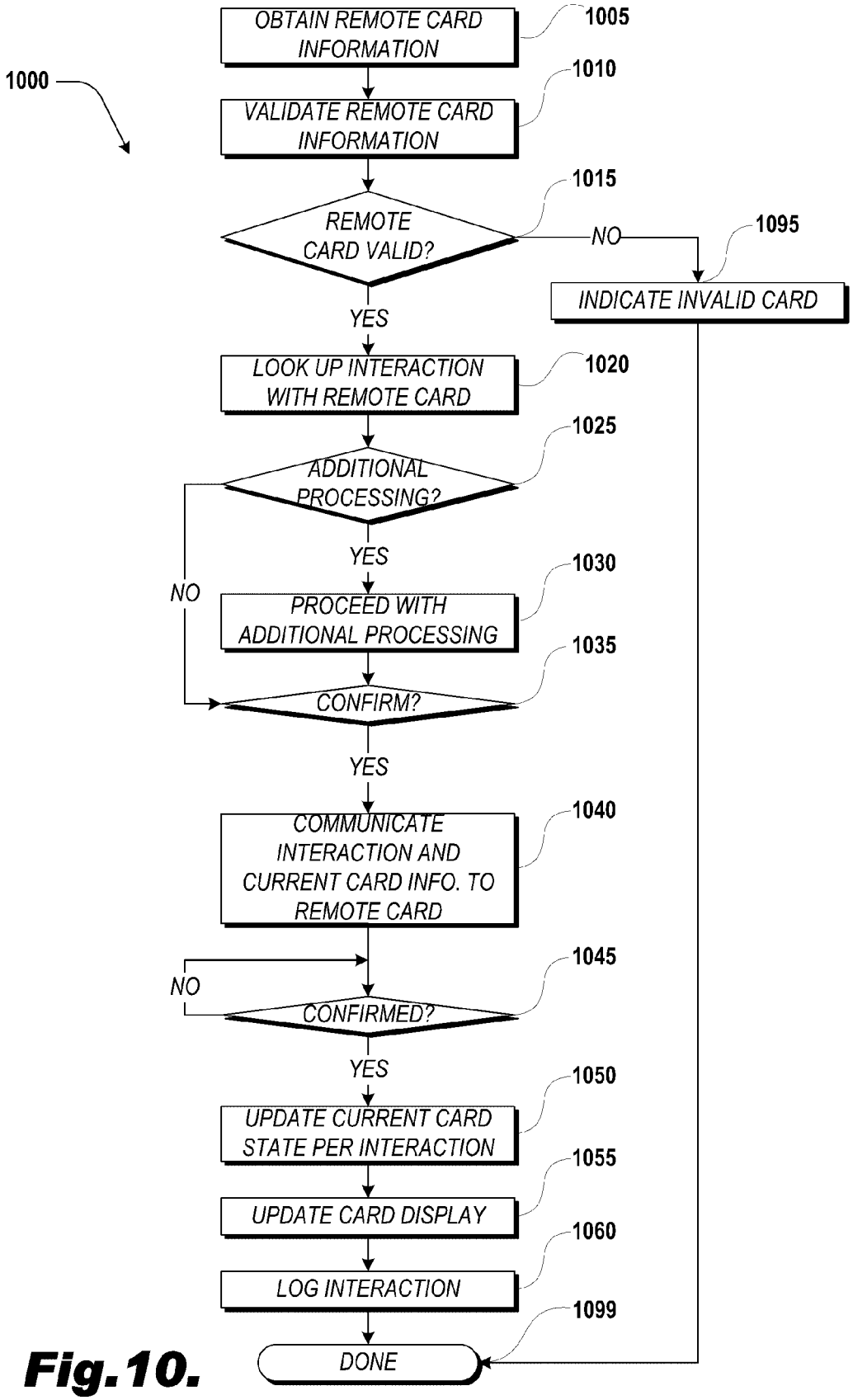
FIG. 10 is a flow diagram illustrating a card interaction routine in accordance with one embodiment.

FIG. 10 illustrates one exemplary flow diagram of processes performed within a card 700 when interacting with one or more other cards. In block 1005 remote card information is obtained. In block 1010 the remote card information is validated. If, in decision block 1015, it was determined that the remote card is valid for this interaction, processing proceeds to block 1020 where the interaction with the remote card is looked up.

In some embodiments, looking up an interaction with the remote card may be as simple as finding an intersection in a database between two cards. In other embodiments the look up of an interaction may involve combining the values of multiple cards and/or multiple dimensions within a database to determine a specific interaction (e.g., looking up ability point values, rules, characteristics and the like). In still further embodiments, such as those described above, the interaction may be determined by the characteristics of the cards and not by the specific cards themselves.

In decision block 1025, a determination is made whether any additional processing is needed for the interaction to proceed. If so, then processing proceeds to block 1030 where additional processing begins. In some embodiments, additional processing may include the generation of random values, the gathering of additional card information, or communicating with remote devices, such as a base 300.

Once the additional processing has been completed, processing proceeds to decision block 1035. If, in decision block 1025, it was determined that no additional processing is required, processing would also proceed to decision block 1035 where a determination is made whether to confirm the interaction with the remote card from which the information was received. If so, processing proceeds to block 1040 where the interaction and current card information are sent to the remote card. Next, in block 1045 a determination is made whether the interaction was confirmed. Once the interaction has been confirmed, processing proceeds to block 1050.

If in decision block 1035 it was determined that no confirmation was necessary; processing would also proceed to block 1050 where the current card state 760 is updated per the interaction. Next, in block 1055 the card display is updated and in block 1060, the interaction is logged. Card interactions routine 1000 ends at block 1099.

Returning to block 1015, if it was determined that the remote card is not valid for this interaction, processing proceeds to block 1095 where an indication of an invalid card and/or invalid transaction is indicated, after which processing proceeds to block 1099.

In further embodiments, cards may direct other computing devices. For example, a player can tap on a card with a monster's picture, which would cause the card to instruct the PC to load a particular web page with information on that monster.

The simple and complex dynamic cards that have been discussed above relate in particular to games and interactions between cards for competitive purposes. Dynamic cards may also be used in a variety of other pastimes; one such pastime involves collectible cards. It is noted that by no means are the two types of card activities mutually exclusive: collectible cards may also be used for competitive purposes (e.g., as fantasy trading cards) and vice versa.

Figure 11A:
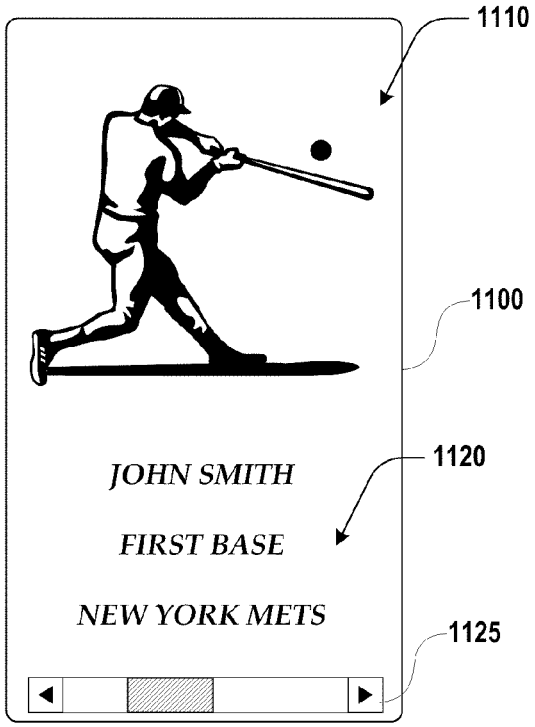
FIGS. 11A-B are pictorial diagrams of sides of an exemplary trading card in accordance with one embodiment.
Figure 11B:
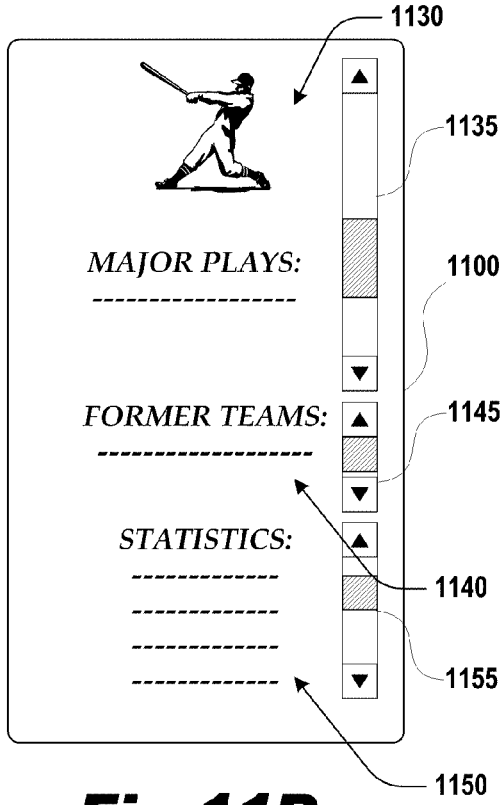

FIGS. 11A-B illustrate two sides of an exemplary dynamic collectible card 1100. The exemplary dynamic collectible card 1100 includes a picture 1110 of a sports player and information about the player 1120 along with a user interface 1125 (in this case a scroll bar). On the other side of the card there is another picture 1130 along with associated text having its own user interface 1135 as well as additional information 1140, 1150 with respective user interfaces 1145, 1155.

While not all of the illustrated information is necessary in a dynamic collectible card 1100, FIGS. 11A-B are meant to illustrate one example of a dynamic collectible card 1100 which could integrate multiple collectible cards within a single collectible card. For example, the dynamic collectible card 1100 may involve a single player, and the player can have their information updated periodically either through the interactions with other cards (similar to companion cards described above) or through some other communication mechanism (e.g., computer network, radio broadcast, television broadcast, or the like).

In one exemplary embodiment, the dynamic collectible card 1100 is updated via combinations with other collectible cards. For example, if a "John Smith" rookie card (not shown) was placed in contact with a separate John Smith card from a later year (not shown), one or the other of the cards may absorb the information from the other card such that a combined card contains the information for both cards (possibly leaving a blank card behind, or alternately leaving two updated cards).

In some embodiments, cards may update their information permanently by a communications link. For example, sports cards might update their information automatically based on a radio broadcast.

In other embodiments, different types of groupings may be employed, for example, combining all the players of a single team onto a single card. Or, all the players of a particular position within a league on a particular card, or the like.

Figure 12:
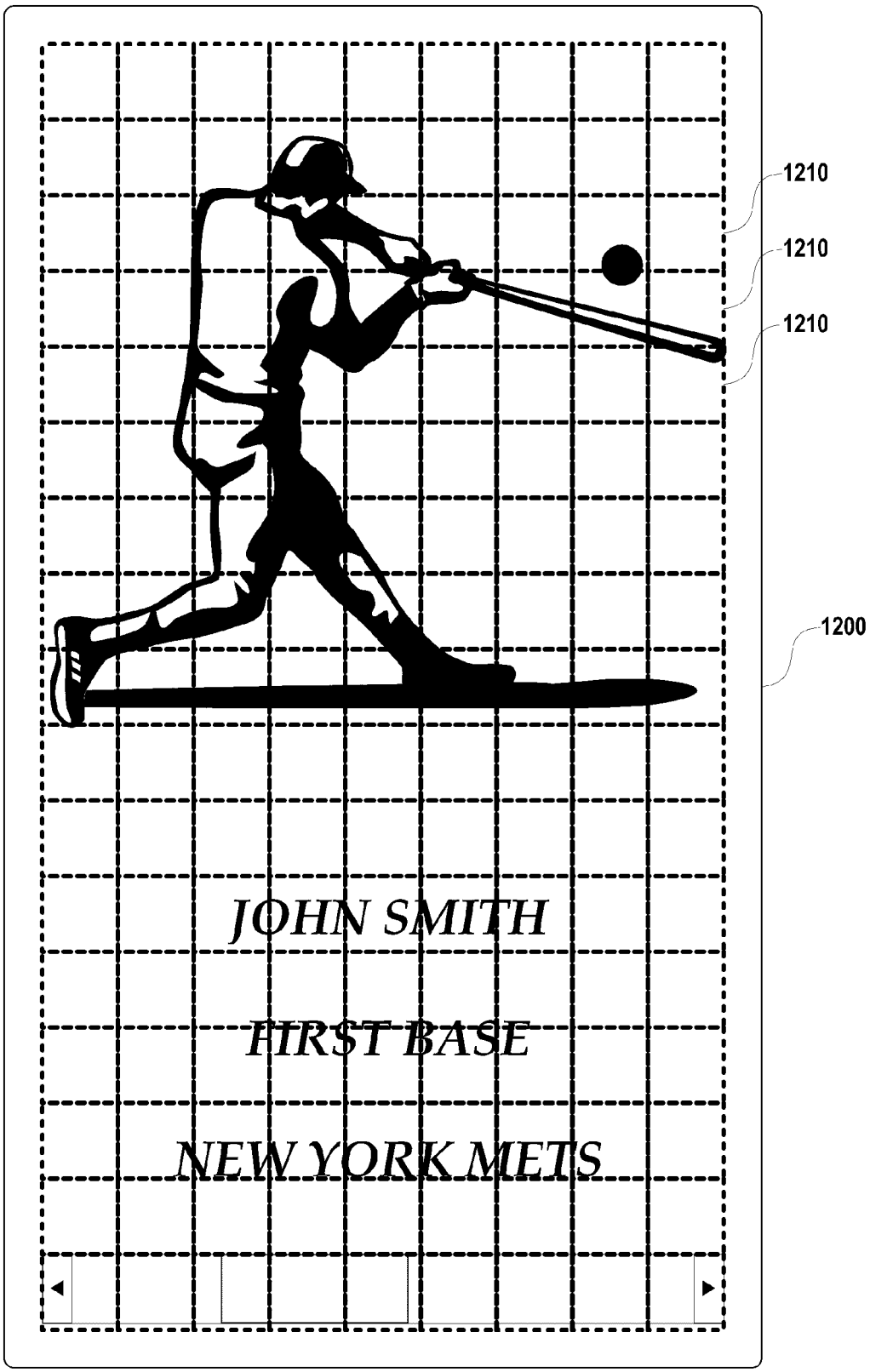
FIG. 12 is a pictorial diagram of a dynamic card having a touch interface in accordance with one embodiment.

FIG. 12 illustrates an exemplary touch-sensitive card 1200 that has touch-sensitive cells 1210 across the surface of the card, thereby allowing a user to interact with the display of the card 1200. Such touch sensitive cells 1210 maybe combined with "static or dynamic" user interface components, such as those shown in figure of 11A-B. For example, a printed (or dynamically displayed) image of a button (not shown) may have an associated touch sensitive component that would alter the display, behavior and or data of a card.

Alternately, such cards may allow for more sensitive interactions, such as sensing a fingerprint or capturing a player's signature.

In another example, in games such as Blackjack, where the strength of a player's hand is not clear, the cards may show "20" or "Soft 16" for the player's benefit. In trivia games, the question cards might also display a team's scores or other statistics.

Figure 13:
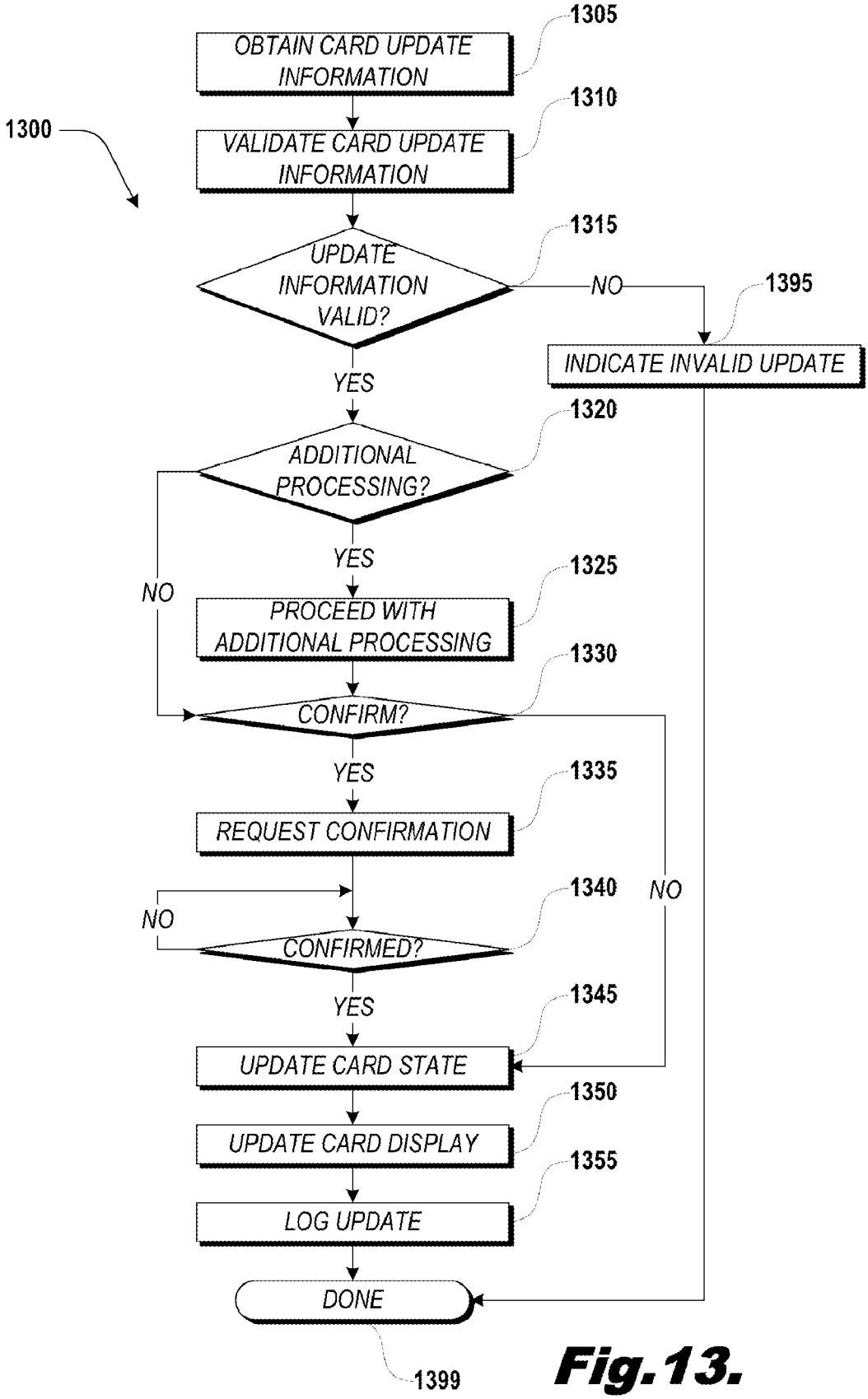
FIG. 13 is a flow diagram illustrating a card update routine in accordance with one embodiment.

FIG. 13 illustrates one exemplary dynamic collectible card update routine 1300. In block 1305 remote card information is obtained. In block 1310 the remote card information is validated. If in decision block 1315 it was determined that the remote card is valid for this interaction, processing proceeds to block 1320 where the interaction with the remote card is looked up.

In some embodiments, looking up an interaction with the remote card may be as simple as finding an intersection in a database between two cards. In other embodiments the look up of an interaction may involve combining the values of multiple cards and/or multiple dimensions within a database to determine a specific interaction (e.g., looking up ability point values, rules, characteristics and the like). In still further embodiments, such as those listed above, the interaction may be determined by the characteristics of the cards and not by the specific cards themselves.

In decision block 1320, a determination is made whether any additional processing is needed for the interaction to proceed. If so, then processing proceeds to block 1325 where additional processing begins. In some embodiments, additional processing may include the generation of random values, the gathering of additional card information, or communicating with remote devices, such as a base 300.

Once the additional processing has been completed, processing proceeds to decision block 1330. Likewise, if in decision block 1320 it was determined that no additional processing is required, processing would also proceed to decision block 1335 where a determination is made whether to confirm the interaction with the remote card from which the information was received. If so, processing proceeds to block 1345 where the interaction and current card information are sent to the remote card. Next, in block 1340 a determination is made whether the interaction was confirmed. Once the interaction has been confirmed, processing proceeds to block 1345.

Likewise, if in decision block 1330 it was determined that no confirmation was necessary; processing would also proceed to block 1345, where the current card state is updated per the interaction. Next, in block 1350 the card display is updated and in block 1355, the interaction is logged. Next, card interactions routine 1300 ends at block 1399.

Returning to block 1315, if it was determined that the remote card is not valid for this interaction, processing proceeds to block 1395 where an indication of an invalid card and/or invalid transaction is indicated, after which processing proceeds to block 1399.

Figure 14:
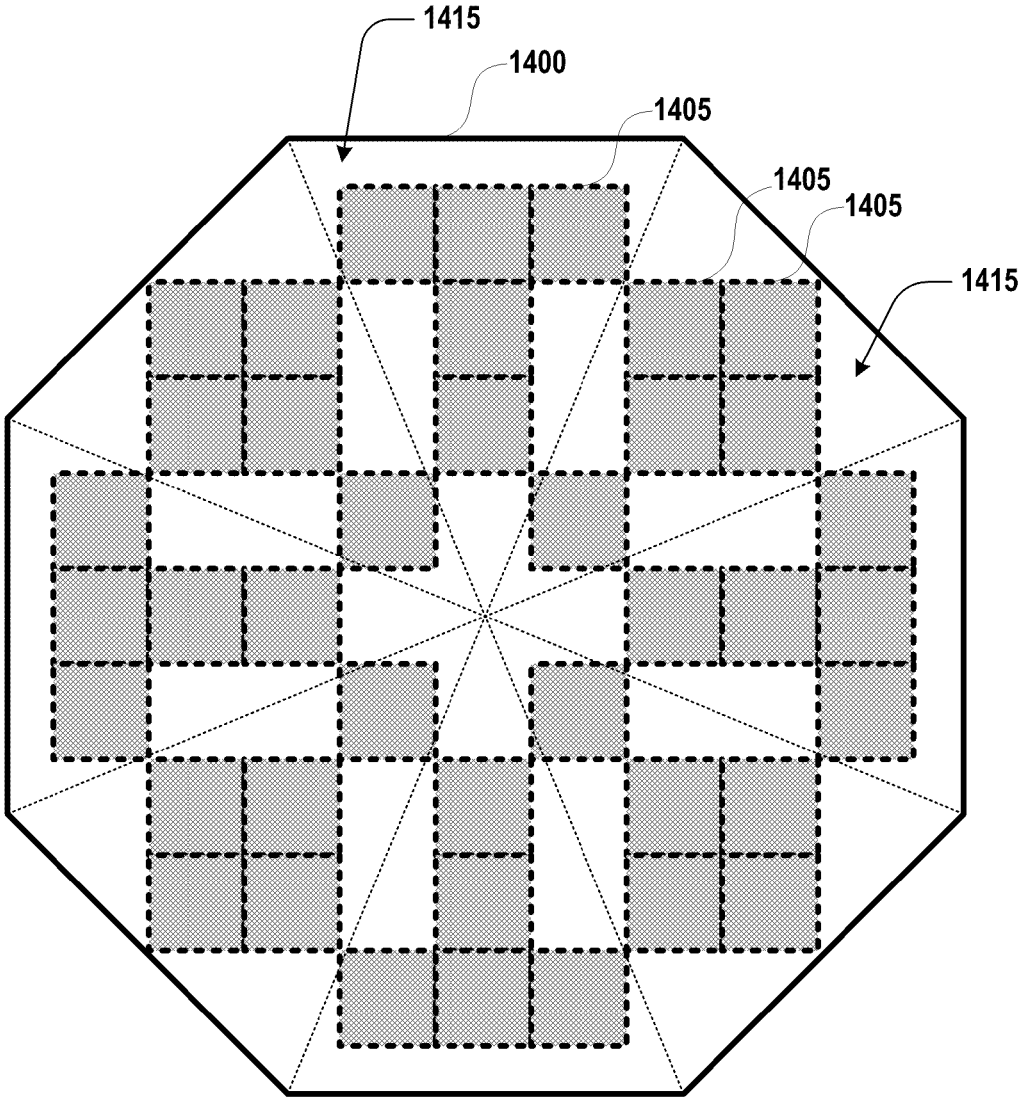
FIG. 14 is a pictorial diagram of an exemplary card game playing surface in accordance with one embodiment.

As often as cards may communicate with one another, in some circumstances it may not feasible or efficient to always have all cards in a game in physical contact with one another. Accordingly, FIG. 14 illustrates a simple game surface 1400 suitable for having up to eight different players play their cards with each other. The playing surface 1400 may be separated into slices 1415, each of which contains active cells 1405 that can detect and communicate with dynamic cards on their surface. In some embodiments, these cells 1405 may communicate with a complex dynamic cards communication medium 810 to send communication information between cards on the playing surface.

An additional benefit of such a playing surface 1400 is that it may also communicate or convey power to cards 700 which have a power reception capability or a rechargeable power supply 745. Additional embodiments may include interactions with/between the cells 1405 with the sensors 725 of the cards 700.

Figure 15:
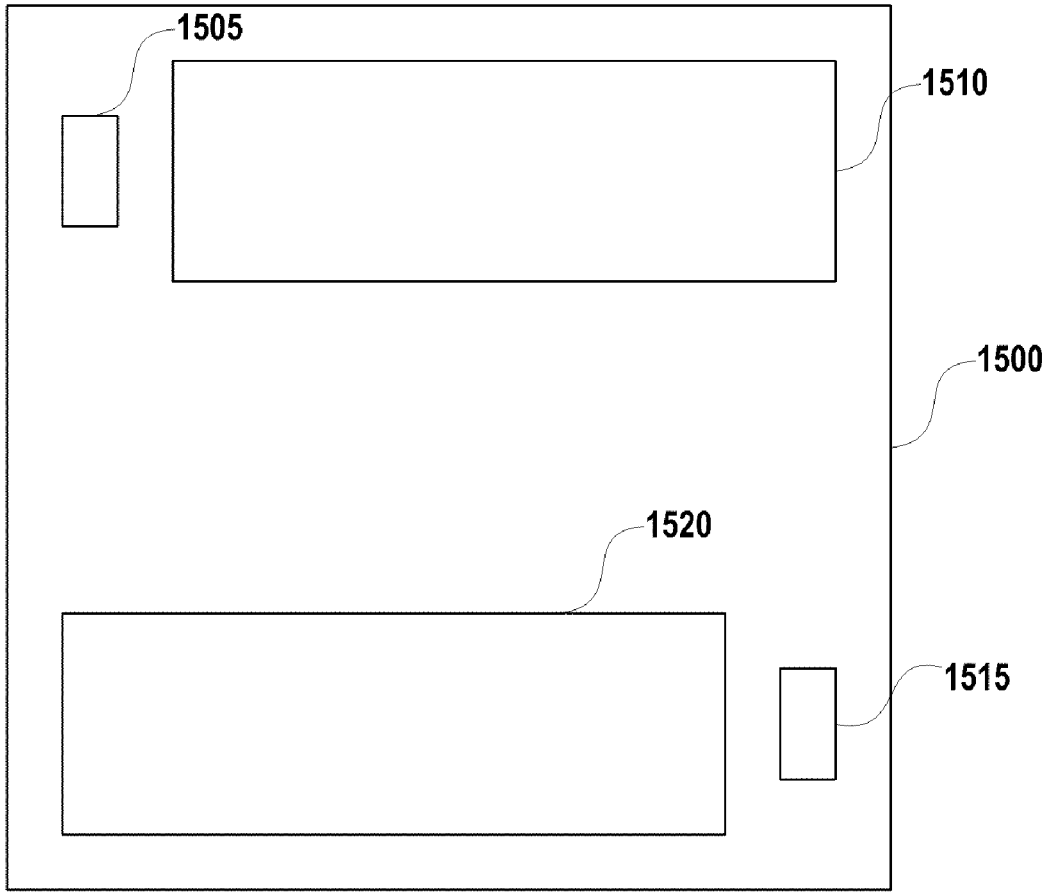
FIG. 15 is a pictorial diagram of an alternate card game playing surface in accordance with one embodiment.

Similarly, FIG. 15 illustrates a simple remote card playing card game surface 1500 where two players can play a game remotely with complex dynamic cards 700. A local player can use a local card surface 1510 and a local card receptacle 1515 (e.g., a card base 300 or the like) to play against the remote opponent who has their cards displayed on a remote playing display 1520. With each player having such a surface, it is possible for two (or more) players to use the surface 1500 as a way of playing cards with each other. The remote playing surface 1500 would operate in a similar fashion to the segmented playing surface 1400 illustrated in FIG. 14 except that it would increase the distance over which card information would be communicated. Additionally, the remote playing surface 1500 would communicate card display information on to the remote display 1520 of respective players.

In an alternate embodiment, other devices may facilitate remote card play. For example, electronic game devices (either handheld devices or console game devices, not shown) may provide a suitable platform to input card information (e.g., with a modified controller that is capable of reading/recognizing a card, not shown) and communicate the card information to one or more other remote game devices, thereby allowing remote card play. Of course, general-purpose computing devices may also be suitable for such facilitated remote card play.

In the described embodiments above, some embodiments have used card bases 300 while still others have not. In various embodiments, particularly those which have intelligent interactions and rules encoded in instructions within the cards, e.g., complex dynamic cards 700 and the like, card bases 300 may not be necessary. However, in some embodiments it may be desirable to have a card base 300, even for complex dynamic cards 700.

Figure 16:
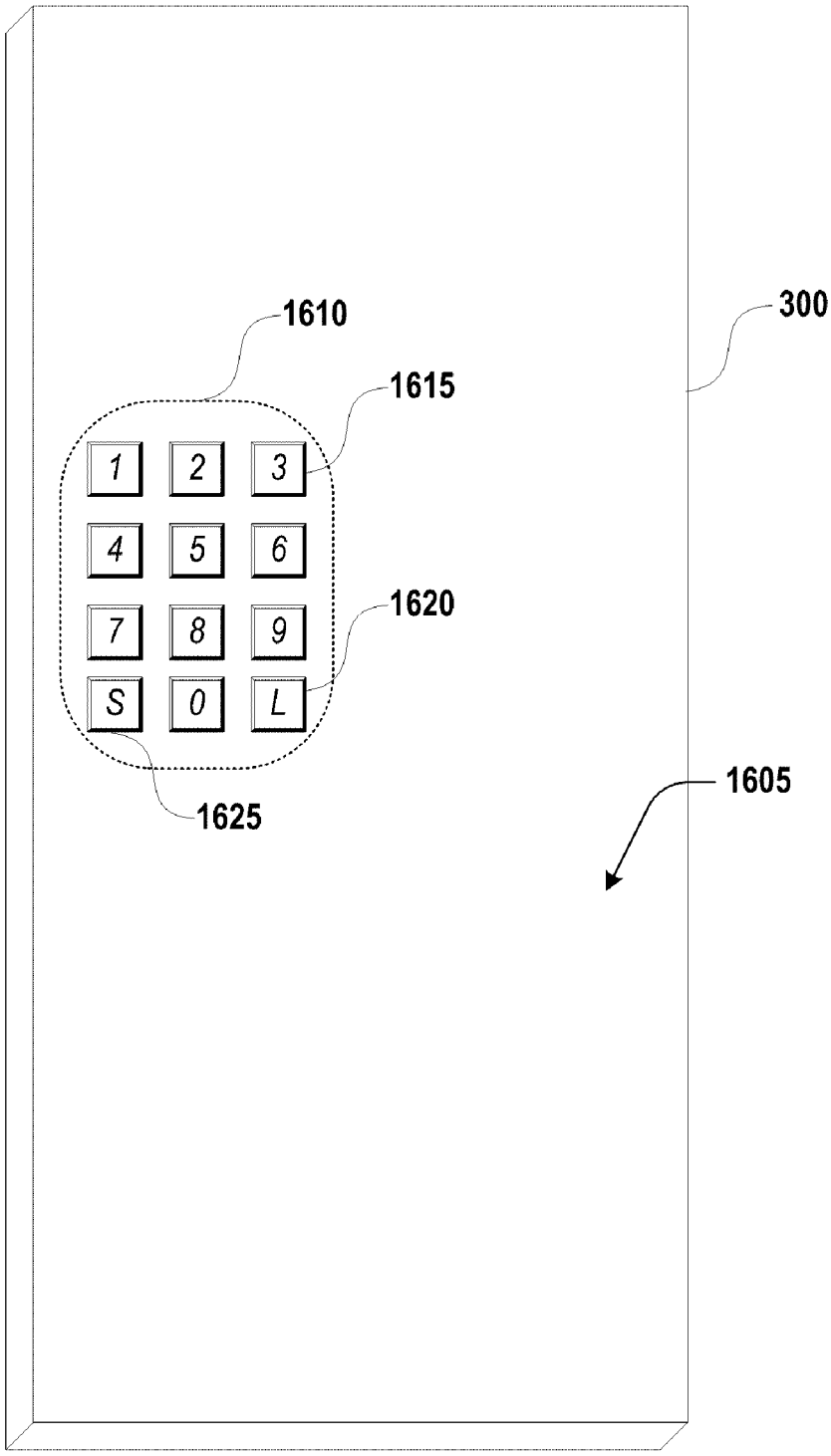
FIG. 16 is a pictorial diagram of an alternate card base in accordance with one embodiment.

Accordingly, FIG. 16 illustrates one exemplary enhanced card base 300 having numeric pad of 1610 as a locking mechanism. The numeric pad comprising numeric keys 1615, a lock key 1620 and a set key 1625 for setting numeric combinations as well as a display 340 which may be used in selecting one or more cards within the card case 300. Such a card case 300 may be desirable when the number of cards that a player owns exceeds the number of physical cards they wish to carry with them. The enhanced card case 300 illustrated in FIG. 16 is an exemplary embodiment of a card case 300 suited for storing a large number of cards 700, and then selecting, through the user interface display 340, only those cards desired to be retrieved from the base. Likewise, such a card case 300 may be employed to carry different types of cards for use with different types of games and/or interactions (or even collections) but may be encoded from a base's memory 350 into programmable cards that may then be dispensed from the base 300.

While a number of exemplary implementations and embodiments have been described and illustrated, other embodiments are also possible. For example, cards may communicate with each other and other devices (e.g., game boards, game pieces, dice, computers, displays, phones, network devices and the like). Such communications may take place via physical (e.g., wired, touch, contact or the like) connections or via wireless connections (e.g., WiFi, WiMax, RFID, blue tooth, infrared or the like). These communications may simply report games status, or in some embodiments may be integrated into the game playing experience. For example, a card may indicate that a games piece should move to a new location, and the game piece may blink an indicator until it is in a correct position.

Some cards, in various embodiments, may have different capabilities, including, but not limited to, different communications capabilities. For example, a simple card might only have a physical contact communications connection, while a more complex card could have one or more wireless connections. Additionally, some cards may even allow other cards to communicate by acting as interfaces to the cards without the same communications capabilities. Furthermore, such cards may allow communications with other devices or game components (e.g., dice, markers, game boards and the like). Likewise, other game pieces may communicate in similar fashions to cards.

Other abilities may include, cards used as random number generators. For example, the card could just be tapped to produce a "die roll." In addition, cards may display random data. For example, in one game, a player might be forced to make a word out of randomly chosen letters displayed by the card.

In one exemplary embodiment, cards can load data from other cards. For example, a player may clone a desired card by copying data to a blank "wild" card.

In addition to interacting with each other, cards may interact with other devices. For example, a website promotion that "gives experience" to a specific card would be possible so long as the device is capable with communicating to both the card and the website. Therefore, in one specific embodiment, a personal computer with a card reading peripheral, and a network connection, could share information from the website to a card that would provide experience point data to the card and possibly modify its game play behavior.

In still another example, a device could be used to add and/or modify questions and/or answers to cards in a trivia game. Alternately, cards may interact with a game board. For example, a question card in a trivia game displays a question from the correct category based on the player's location on the game board. In still another example, cards can reflect information from a central data source. For example, in a trivia game, there may be one card per team, and the card receives appropriate questions from a central data source (such as a base 300 or remote device).

Likewise, in a trivia game, cards may reveal information sequentially. For example, a trivia card might only reveal its answer after the players had guessed. Additionally, cards may evaluate player actions. A trivia card might have game rules 765 that would indicate if the player's guess was right or wrong.

As already noted, cards may have both static and dynamic elements. In some embodiments, the display 740 may modify a static image that is part of a card. A static figure might have eyes that move or blink, or text maybe personally modifiable. For example in a printed portion of a card with the word "strength" and the dynamic display, the dynamic display may be adjusted to display the number "17". Over time, and/or game play, the dynamic number displayed next to the word strength may change accordingly.

In further embodiments, elements of the display 740 may cover otherwise visible, transmissible static elements of a card. In one specific embodiment, cards may be deceptive. For example, an apparently normal deck of cards where all cards can be turned into aces may be used for magic tricks.

Some embodiments may have types of cards that are identifiable by each individual cards (e.g., by owner specified information, serial numbers, deck numbers, card type, activation information or the like). In addition, some cards maybe associated with one or more individuals, possibly including a current owner of the card. In such an embodiment, it may be possible to specify a rule that makes it permissible for only the owner of a card to use the card and game play.

Various cards may also store additional information not readily viewable on the display 740. For example, sports cards may have additional statistics for a competitive card game not visible to a player, that would only become useful (and visible) when the player acquires a second or other enabling device (such as another card from the same game). Some cards may have different physical appearances based on their state. A "spell book" card may appear to "open" when placed in the playing position. Likewise, a fighter card may show the fighter wearing armor when an Armor Card is placed underneath it.

In alternate embodiments, CDC 700 may provide access to real-world events independent of any game. For example, a card can be a ticket to a concert. It has a video clip of the concert, can display directions to the venue, and contains security code to make it difficult to forge.

Although specific embodiments have been illustrated and described herein, it will be appreciated by those of ordinary skill in the art that a wide variety of alternate and/or equivalent implementations may be substituted for the specific embodiments shown and described without departing from the scope of the present invention. This application is intended to cover any adaptations or variations of the embodiments discussed herein. Therefore, it is manifestly intended that this invention be limited only by the claims and the equivalents thereof.

What is claimed is:

1. A dynamic entertainment card comprising:

a flexible substrate in the form of a selected one of a playing card, a trading card, and a collectible card, said substrate having a front face and a back face and being suitable for being held in a player's hand as one of a plurality of like dynamic entertainment cards during a card game;

an electronic circuit coupled to said substrate;

an input interface coupled to said electronic circuit;

a flexible display coupled with said electronic circuit and mounted on said front face;

a memory, coupled to said electronic circuit, containing executable instructions for card-game rules; and a processor coupled to said flexible display and said memory to facilitate gameplay of said card game by applying said executable instructions for said card-game rules;

the dynamic entertainment card operative to:

apply said executable instructions for said card-game rules by said processor-coupled-to-said-flexible-display-of-the-dynamic-entertainment-card to determine a first card-state in said card game;

display a first image on said flexible display mounted on said front face according to said first card-state; and as said gameplay of said card game progresses:

obtain entertainment information via said input interface;

apply said executable instructions for said game rules by said processor-coupled-to-said-flexible-display-of-the-dynamic-entertainment-card to determine a second card-state in said card game according to said entertainment information; and change said flexible display to display a second image on said flexible display mounted on said front face according to said second card-state;

wherein said entertainment information includes proximity information indicating that a second dynamic entertainment card is in physical proximity to the dynamic entertainment card.

2. The dynamic entertainment card of claim 1, wherein the dynamic entertainment card is further operative to, as said gameplay of said card game progresses:

apply said executable instructions for said game rules by said processor-coupled-to-said-flexible-display-of-the-dynamic-entertainment-card to determine a third card-state in said card game according to said proximity information; and change said flexible display to display a third image on said flexible display mounted on said front face according to said third card-state.

3. The dynamic entertainment card of claim 1, further comprising an orientation sensor communicatively coupled with said input interface, and wherein said entertainment information, according to which said second card-state is determined, includes orientation information indicating a physical orientation of the dynamic entertainment card.

4. The dynamic entertainment card of claim 1, further comprising a touch-sensitive component communicatively coupled with said input interface.

5. The dynamic entertainment card of claim 1, further comprising a touch-sensitive component communicatively coupled with said input interface, wherein the dynamic entertainment card is further operative to, as said gameplay of said card game progresses:

apply said executable instructions for said game rules by said processor-coupled-to-said-flexible-display-of-the-dynamic-entertainment-card to determine a third card-state in said card game according to said touch-information; and change said flexible display to display a third image on said flexible display mounted on said front face according to said third card-state.

6. The dynamic entertainment card of claim 1, further comprising:

a clock; and wherein said entertainment information, according to which said second card-state is determined, includes time-tracking information.

7. The dynamic entertainment card of claim 1, wherein said input interface comprises an electronic connection.

8. The dynamic entertainment card of claim 1, wherein said input interface comprises a wireless connection.

9. The dynamic entertainment card of claim 1, wherein said memory further stores ownership information indicating an identity of a card-game player who owns the dynamic entertainment card.

10. The dynamic entertainment card of claim 1:

wherein said memory further stores ownership information indicating an identity of a card-game player who owns the dynamic entertainment card;

wherein said entertainment information obtained via said input interface includes second ownership information indicating a second identity of a second card-game player who owns a second dynamic entertainment card;

wherein determining said second card-state in said card game according to said entertainment information comprises transferring said second ownership information to said memory; and wherein said second image displayed on said flexible display indicates a transfer of ownership of the dynamic entertainment card from said card-game player to said second card-game player.

11. The dynamic entertainment card of claim 1, wherein determining said second card-state in said card game comprises determining that the dynamic entertainment card may only be used a limited number of times; and wherein said second image, displayed on said flexible display as said gameplay progresses, indicates that the dynamic entertainment card can no longer be used in said card game.

12. The dynamic entertainment card of claim 1, further operative to validate that said entertainment information conforms to said card-game rules as said gameplay of said card game progresses.

13. The dynamic entertainment card of claim 1, further operative to log said obtained entertainment information and said determined second card-state to said memory of the dynamic entertainment card.

14. The dynamic entertainment card of claim 1, wherein said entertainment information includes orientation information indicating how the dynamic entertainment card is physically oriented, and wherein said second card-state in said card game is determined according to said orientation information.

15. The dynamic entertainment card of claim 1, further operative to adjust, in said memory, a value of a game-related characteristic of the dynamic entertainment card according to a dynamic evolution of the card over the course of said gameplay of said card game.

16. The dynamic entertainment card of claim 1, wherein determining said second card-state in said card game comprises ranking said entertainment information according to a qualitative skill metric associated with said player during said card game.

17. The dynamic electronic game card of claim 1, further comprising a second flexible display coupled to said electronic circuit and mounted on said back face.

18. A dynamic entertainment card comprising:

a flexible substrate in the form of a selected one of a playing card, a trading card, and a collectible card, said substrate having a front face and a back face and being suitable for being held in a player's hand as one of a plurality of like dynamic entertainment cards during a card game;

an electronic circuit coupled to said substrate;

an input interface coupled to said electronic circuit;

an orientation sensor communicatively coupled with said input interface;

a flexible display coupled with said electronic circuit and mounted on said front face;

a memory, coupled to said electronic circuit, containing executable instructions for card-game rules; and a processor coupled to said flexible display and said memory to facilitate gameplay of said card game by applying said executable instructions for said card-game rules;

the dynamic entertainment card operative to:

apply said executable instructions for said card-game rules by said processor-coupled-to-said-flexible-display-of-the-dynamic-entertainment-card to determine a first card-state in said card game;

display a first image on said flexible display mounted on said front face according to said first card-state; and as said gameplay of said card game progresses:

obtain entertainment information via said input interface;

apply said executable instructions for said game rules by said processor-coupled-to-said-flexible-display-of-the-dynamic-entertainment-card to determine a second card-state in said card game according to said entertainment information; and change said flexible display to display a second image on said flexible display mounted on said front face according to said second card-state;

wherein said entertainment information, according to which said second card-state is determined, includes orientation information indicating a physical orientation of the dynamic entertainment card.

19. The dynamic entertainment card of claim 18, wherein said entertainment information includes proximity information indicating that a second dynamic entertainment card is in physical proximity to the dynamic entertainment card.

20. The dynamic entertainment card of claim 18, wherein said entertainment information includes proximity information indicating that a second dynamic entertainment card is in physical proximity to the dynamic entertainment card; and wherein the dynamic entertainment card is further operative to, as said gameplay of said card game progresses:

apply said executable instructions for said game rules by said processor-coupled-to-said-flexible-display-of-the-dynamic-entertainment-card to determine a third card-state in said card game according to said proximity information; and change said flexible display to display a third image on said flexible display mounted on said front face according to said third card-state.

21. The dynamic entertainment card of claim 18, further comprising a touch-sensitive component communicatively coupled with said input interface.

22. The dynamic entertainment card of claim 18, further comprising a touch-sensitive component communicatively coupled with said input interface; and wherein the dynamic entertainment card is further operative to, as said gameplay of said card game progresses:

apply said executable instructions for said game rules by said processor-coupled-to-said-flexible-display-of-the-dynamic-entertainment-card to determine a third card-state in said card game according to said touch-information; and change said flexible display to display a third image on said flexible display mounted on said front face according to said third card-state.

23. The dynamic entertainment card of claim 18, further comprising:

a clock; and wherein said entertainment information, according to which said second card-state is determined, includes time-tracking information.

24. The dynamic entertainment card of claim 18, wherein said input interface comprises an electronic connection.

25. The dynamic entertainment card of claim 18, wherein said input interface comprises a wireless connection.

26. The dynamic entertainment card of claim 18, wherein said memory further stores ownership information indicating an identity of a card-game player who owns the dynamic entertainment card.

27. The dynamic entertainment card of claim 18:

wherein said memory further stores ownership information indicating an identity of a card-game player who owns the dynamic entertainment card;

wherein said entertainment information obtained via said input interface includes second ownership information indicating a second identity of a second card-game player who owns a second dynamic entertainment card;

wherein determining said second card-state in said card game according to said entertainment information comprises transferring said second ownership information to said memory; and wherein said second image displayed on said flexible display indicates a transfer of ownership of the dynamic entertainment card from said card-game player to said second card-game player.

28. The dynamic entertainment card of claim 18, wherein determining said second card-state in said card game comprises determining that the dynamic entertainment card may only be used a limited number of times; and wherein said second image, displayed on said flexible display as said gameplay progresses, indicates that the dynamic entertainment card can no longer be used in said card game.

29. The dynamic entertainment card of claim 18, further operative to validate that said entertainment information conforms to said card-game rules as said gameplay of said card game progresses.

30. The dynamic entertainment card of claim 18, further operative to log said obtained entertainment information and said determined second card-state to said memory of the dynamic entertainment card.

31. The dynamic entertainment card of claim 18, wherein said entertainment information includes orientation information indicating how the dynamic entertainment card is physically oriented, and wherein said second card-state in said card game is determined according to said orientation information.

32. The dynamic entertainment card of claim 18, further operative to adjust, in said memory, a value of a game-related characteristic of the dynamic entertainment card according to a dynamic evolution of the card over the course of said gameplay of said card game.

33. The dynamic entertainment card of claim 18, wherein determining said second card-state in said card game comprises ranking said entertainment information according to a qualitative skill metric associated with said player during said card game.

34. The dynamic electronic game card of claim 18, further comprising a second flexible display coupled to said electronic circuit and mounted on said back face.

35. A dynamic entertainment card comprising:

a flexible substrate in the form of a selected one of a playing card, a trading card, and a collectible card, said substrate having a front face and a back face and being suitable for being held in a player's hand as one of a plurality of like dynamic entertainment cards during a card game;

an electronic circuit coupled to said substrate;

an input interface coupled to said electronic circuit;

a clock;

a flexible display coupled with said electronic circuit and mounted on said front face;

a memory, coupled to said electronic circuit, containing executable instructions for card-game rules; and a processor coupled to said flexible display and said memory to facilitate gameplay of said card game by applying said executable instructions for said card-game rules;

the dynamic entertainment card operative to:

apply said executable instructions for said card-game rules by said processor-coupled-to-said-flexible-display-of-the-dynamic-entertainment-card to determine a first card-state in said card game;

display a first image on said flexible display mounted on said front face according to said first card-state; and as said gameplay of said card game progresses:

obtain entertainment information via said input interface;

apply said executable instructions for said game rules by said processor-coupled-to-said-flexible-display-of-the-dynamic-entertainment-card to determine a second card-state in said card game according to said entertainment information; and change said flexible display to display a second image on said flexible display mounted on said front face according to said second card-state;

wherein said entertainment information, according to which said second card-state is determined, includes time-tracking information.

36. The dynamic entertainment card of claim 35, wherein said entertainment information includes proximity information indicating that a second dynamic entertainment card is in physical proximity to the dynamic entertainment card.

37. The dynamic entertainment card of claim 35, wherein said entertainment information includes proximity information indicating that a second dynamic entertainment card is in physical proximity to the dynamic entertainment card; and wherein the dynamic entertainment card is further operative to, as said gameplay of said card game progresses:

apply said executable instructions for said game rules by said processor-coupled-to-said-flexible-display-of-the-dynamic-entertainment-card to determine a third card-state in said card game according to said proximity information; and change said flexible display to display a third image on said flexible display mounted on said front face according to said third card-state.

38. The dynamic entertainment card of claim 35, further comprising an orientation sensor communicatively coupled with said input interface, and wherein said entertainment information, according to which said second card-state is determined, includes orientation information indicating a physical orientation of the dynamic entertainment card.

39. The dynamic entertainment card of claim 35, further comprising a touch-sensitive component communicatively coupled with said input interface.

40. The dynamic entertainment card of claim 35, further comprising a touch-sensitive component communicatively coupled with said input interface, wherein the dynamic entertainment card is further operative to, as said gameplay of said card game progresses:

apply said executable instructions for said game rules by said processor-coupled-to-said-flexible-display-of-the-dynamic-entertainment-card to determine a third card-state in said card game according to said touch-information; and change said flexible display to display a third image on said flexible display mounted on said front face according to said third card-state.

41. The dynamic entertainment card of claim 35, wherein said input interface comprises an electronic connection.

42. The dynamic entertainment card of claim 35, wherein said input interface comprises a wireless connection.

43. The dynamic entertainment card of claim 35, wherein said memory further stores ownership information indicating an identity of a card-game player who owns the dynamic entertainment card.

44. The dynamic entertainment card of claim 35:

wherein said memory further stores ownership information indicating an identity of a card-game player who owns the dynamic entertainment card;

wherein said entertainment information obtained via said input interface includes second ownership information indicating a second identity of a second card-game player who owns a second dynamic entertainment card;

wherein determining said second card-state in said card game according to said entertainment information comprises transferring said second ownership information to said memory; and wherein said second image displayed on said flexible display indicates a transfer of ownership of the dynamic entertainment card from said card-game player to said second card-game player.

45. The dynamic entertainment card of claim 35, wherein determining said second card-state in said card game comprises determining that the dynamic entertainment card may only be used a limited number of times; and wherein said second image, displayed on said flexible display as said gameplay progresses, indicates that the dynamic entertainment card can no longer be used in said card game.

46. The dynamic entertainment card of claim 35, further operative to validate that said entertainment information conforms to said card-game rules as said gameplay of said card game progresses.

47. The dynamic entertainment card of claim 35, further operative to log said obtained entertainment information and said determined second card-state to said memory of the dynamic entertainment card.

48. The dynamic entertainment card of claim 35, wherein said entertainment information includes orientation information indicating how the dynamic entertainment card is physically oriented, and wherein said second card-state in said card game is determined according to said orientation information.

49. The dynamic entertainment card of claim 35, further operative to adjust, in said memory, a value of a game-related characteristic of the dynamic entertainment card according to a dynamic evolution of the card over the course of said gameplay of said card game.

50. The dynamic entertainment card of claim 35, wherein determining said second card-state in said card game comprises ranking said entertainment information according to a qualitative skill metric associated with said player during said card game.

51. The dynamic electronic game card of claim 35, further comprising a second flexible display coupled to said electronic circuit and mounted on said back face.

52. A dynamic entertainment card comprising:

a flexible substrate in the form of a selected one of a playing card, a trading card, and a collectible card, said substrate having a front face and a back face and being suitable for being held in a player's hand as one of a plurality of like dynamic entertainment cards during a card game;

an electronic circuit coupled to said substrate;

an input interface coupled to said electronic circuit;

a flexible display coupled with said electronic circuit and mounted on said front face;

a memory, coupled to said electronic circuit, containing executable instructions for card-game rules; and a processor coupled to said flexible display and said memory to facilitate gameplay of said card game by applying said executable instructions for said card-game rules;

the dynamic entertainment card operative to:

apply said executable instructions for said card-game rules by said processor-coupled-to-said-flexible-display-of-the-dynamic-entertainment-card to determine a first card-state in said card game;

display a first image on said flexible display mounted on said front face according to said first card-state; and as said gameplay of said card game progresses:

obtain entertainment information via said input interface;

apply said executable instructions for said game rules by said processor-coupled-to-said-flexible-display-of-the-dynamic-entertainment-card to determine a second card-state in said card game according to said entertainment information; and change said flexible display to display a second image on said flexible display mounted on said front face according to said second card-state;

wherein said memory further stores ownership information indicating an identity of a card-game player who owns the dynamic entertainment card;

wherein said entertainment information obtained via said input interface includes second ownership information indicating a second identity of a second card-game player who owns a second dynamic entertainment card;

wherein determining said second card-state in said card game according to said entertainment information comprises transferring said second ownership information to said memory, and wherein said second image displayed on said flexible display indicates a transfer of ownership of the dynamic entertainment card from said card-game player to said second card-game player.

53. The dynamic entertainment card of claim 52, wherein said entertainment information includes proximity information indicating that a second dynamic entertainment card is in physical proximity to the dynamic entertainment card.

54. The dynamic entertainment card of claim 52, further comprising an orientation sensor communicatively coupled with said input interface, and wherein said entertainment information, according to which said second card-state is determined, includes orientation information indicating a physical orientation of the dynamic entertainment card.

55. The dynamic entertainment card of claim 52, further comprising a touch-sensitive component communicatively coupled with said input interface.

56. The dynamic entertainment card of claim 52, further comprising:

a clock; and wherein said entertainment information, according to which said second card-state is determined, includes time-tracking information.

57. The dynamic entertainment card of claim 52, wherein said input interface comprises a wireless connection.

58. The dynamic entertainment card of claim 52, wherein said memory further stores ownership information indicating an identity of a card-game player who owns the dynamic entertainment card.

59. The dynamic entertainment card of claim 52, further operative to validate that said entertainment information conforms to said card-game rules as said gameplay of said card game progresses.

60. The dynamic entertainment card of claim 52, further operative to log said obtained entertainment information and said determined second card-state to said memory of the dynamic entertainment card.

61. The dynamic entertainment card of claim 52, wherein said entertainment information includes orientation information indicating how the dynamic entertainment card is physically oriented, and wherein said second card-state in said card game is determined according to said orientation information.

62. The dynamic entertainment card of claim 52, wherein determining said second card-state in said card game comprises ranking said entertainment information according to a qualitative skill metric associated with said player during said card game.

63. A dynamic entertainment card comprising:

a flexible substrate in the form of a selected one of a playing card, a trading card, and a collectible card, said substrate having a front face and a back face and being suitable for being held in a player's hand as one of a plurality of like dynamic entertainment cards during a card game;

an electronic circuit coupled to said substrate;

an input interface coupled to said electronic circuit;

a flexible display coupled with said electronic circuit and mounted on said front face;

a memory, coupled to said electronic circuit, containing executable instructions for card-game rules; and a processor coupled to said flexible display and said memory to facilitate gameplay of said card game by applying said executable instructions for said card-game rules;

the dynamic entertainment card operative to:

apply said executable instructions for said card-game rules by said processor-coupled-to-said-flexible-display-of-the-dynamic-entertainment-card to determine a first card-state in said card game;

display a first image on said flexible display mounted on said front face according to said first card-state; and as said gameplay of said card game progresses:

obtain entertainment information via said input interface;

apply said executable instructions for said game rules by said processor-coupled-to-said-flexible-display-of-the-dynamic-entertainment-card to determine a second card-state in said card game according to said entertainment information; and change said flexible display to display a second image on said flexible display mounted on said front face according to said second card-state;

wherein said memory further stores ownership information indicating an identity of a card-game player who owns the dynamic entertainment card;

wherein said entertainment information obtained via said input interface includes second ownership information indicating a second identity of a second card-game player who owns a second dynamic entertainment card;

wherein said entertainment information includes orientation information indicating how the dynamic entertainment card is physically oriented, and wherein said second card-state in said card game is determined according to said orientation information.

64. The dynamic entertainment card of claim 63, wherein said entertainment information includes proximity information indicating that a second dynamic entertainment card is in physical proximity to the dynamic entertainment card.

65. The dynamic entertainment card of claim 63, wherein said entertainment information includes proximity information indicating that a second dynamic entertainment card is in physical proximity to the dynamic entertainment card; and wherein the dynamic entertainment card is further operative to, as said gameplay of said card game progresses:

apply said executable instructions for said game rules by said processor-coupled-to-said-flexible-display-of-the-dynamic-entertainment-card to determine a third card-state in said card game according to said proximity information; and change said flexible display to display a third image on said flexible display mounted on said front face according to said third card-state.

66. The dynamic entertainment card of claim 63, further comprising an orientation sensor communicatively coupled with said input interface, and wherein said entertainment information, according to which said second card-state is determined, includes orientation information indicating a physical orientation of the dynamic entertainment card.

67. The dynamic entertainment card of claim 63, further comprising a touch-sensitive component communicatively coupled with said input interface.

68. The dynamic entertainment card of claim 63, further comprising a touch-sensitive component communicatively coupled with said input interface; and wherein the dynamic entertainment card is further operative to, as said gameplay of said card game progresses:

apply said executable instructions for said game rules by said processor-coupled-to-said-flexible-display-of-the-dynamic-entertainment-card to determine a third card-state in said card game according to said touch-information; and change said flexible display to display a third image on said flexible display mounted on said front face according to said third card-state.

69. The dynamic entertainment card of claim 63, further comprising:

a clock; and wherein said entertainment information, according to which said second card-state is determined, includes time-tracking information.

70. The dynamic entertainment card of claim 63, wherein said input interface comprises an electronic connection.

71. The dynamic entertainment card of claim 63, wherein said input interface comprises a wireless connection.

72. The dynamic entertainment card of claim 63, wherein said memory further stores ownership information indicating an identity of a card-game player who owns the dynamic entertainment card.

73. The dynamic entertainment card of claim 63:

wherein said memory further stores ownership information indicating an identity of a card-game player who owns the dynamic entertainment card;

wherein said entertainment information obtained via said input interface includes second ownership information indicating a second identity of a second card-game player who owns a second dynamic entertainment card;

wherein determining said second card-state in said card game according to said entertainment information comprises transferring said second ownership information to said memory; and wherein said second image displayed on said flexible display indicates a transfer of ownership of the dynamic entertainment card from said card-game player to said second card-game player.

74. The dynamic entertainment card of claim 63, wherein determining said second card-state in said card game comprises determining that the dynamic entertainment card may only be used a limited number of times; and wherein said second image, displayed on said flexible display as said gameplay progresses, indicates that the dynamic entertainment card can no longer be used in said card game.

75. The dynamic entertainment card of claim 63, further operative to validate that said entertainment information conforms to said card-game rules as said gameplay of said card game progresses.

76. The dynamic entertainment card of claim 63, further operative to log said obtained entertainment information and said determined second card-state to said memory of the dynamic entertainment card.

77. The dynamic entertainment card of claim 63, further operative to adjust, in said memory, a value of a game-related characteristic of the dynamic entertainment card according to a dynamic evolution of the card over the course of said gameplay of said card game.

78. The dynamic entertainment card of claim 63, wherein determining said second card-state in said card game comprises ranking said entertainment information according to a qualitative skill metric associated with said player during said card game.

79. The dynamic electronic game card of claim 63, further comprising a second flexible display coupled to said electronic circuit and mounted on said back face.

80. A dynamic entertainment card comprising:

a flexible substrate in the form of a selected one of a playing card, a trading card, and a collectible card, said substrate having a front face and a back face and being suitable for being held in a player's hand as one of a plurality of like dynamic entertainment cards during a card game;

an electronic circuit coupled to said substrate;

an input interface coupled to said electronic circuit;

a flexible display coupled with said electronic circuit and mounted on said front face;

a memory, coupled to said electronic circuit, containing executable instructions for card-game rules; and a processor coupled to said flexible display and said memory to facilitate gameplay of said card game by applying said executable instructions for said card-game rules;

the dynamic entertainment card operative to:

apply said executable instructions for said card-game rules by said processor-coupled-to-said-flexible-display-of-the-dynamic-entertainment-card to determine a first card-state in said card game;

display a first image on said flexible display mounted on said front face according to said first card-state; and as said gameplay of said card game progresses:

obtain entertainment information via said input interface;

apply said executable instructions for said game rules by said processor-coupled-to-said-flexible-display-of-the-dynamic-entertainment-card to determine a second card-state in said card game according to said entertainment information; and change said flexible display to display a second image on said flexible display mounted on said front face according to said second card-state;

wherein determining said second card-state in said card game comprises ranking said entertainment information according to a qualitative skill metric associated with said player during said card game.

81. The dynamic entertainment card of claim 80, wherein said entertainment information includes proximity information indicating that a second dynamic entertainment card is in physical proximity to the dynamic entertainment card.

82. The dynamic entertainment card of claim 80, further comprising an orientation sensor communicatively coupled with said input interface, and wherein said entertainment information, according to which said second card-state is determined, includes orientation information indicating a physical orientation of the dynamic entertainment card.

83. The dynamic entertainment card of claim 80, further comprising a touch-sensitive component communicatively coupled with said input interface.

84. The dynamic entertainment card of claim 80, further comprising:

a clock; and wherein said entertainment information, according to which said second card-state is determined, includes time-tracking information.

85. The dynamic entertainment card of claim 80, wherein said input interface comprises a wireless connection.

86. The dynamic entertainment card of claim 80, wherein said memory further stores ownership information indicating an identity of a card-game player who owns the dynamic entertainment card.

87. The dynamic entertainment card of claim 80:

wherein said memory further stores ownership information indicating an identity of a card-game player who owns the dynamic entertainment card;

wherein said entertainment information obtained via said input interface includes second ownership information indicating a second identity of a second card-game player who owns a second dynamic entertainment card;

wherein determining said second card-state in said card game according to said entertainment information comprises transferring said second ownership information to said memory; and wherein said second image displayed on said flexible display indicates a transfer of ownership of the dynamic entertainment card from said card-game player to said second card-game player.

88. The dynamic entertainment card of claim 80, further operative to validate that said entertainment information conforms to said card-game rules as said gameplay of said card game progresses.

89. The dynamic entertainment card of claim 80, further operative to log said obtained entertainment information and said determined second card-state to said memory of the dynamic entertainment card.

90. The dynamic entertainment card of claim 80, wherein said entertainment information includes orientation information indicating how the dynamic entertainment card is physically oriented, and wherein said second card-state in said card game is determined according to said orientation information.

91. An electronic game system comprising:

a flexible electronic card comprising:

a flexible substrate in the form of a selected one of a playing card, a trading card, and a collectible card, said substrate having a front face and a back face and being suitable for being held in a player's hand as one of a plurality of like dynamic entertainment cards during a card game;

an electronic circuit coupled to said substrate;

a card interface coupled to said electronic circuit;

a flexible display coupled with said electronic circuit and mounted on said front face;

a card memory, coupled to said electronic circuit, containing card data; and the flexible electronic card operative to:

display a first image on said flexible display mounted on said front face according to said first card-state; and as said gameplay of said card game progresses:

obtain a plurality of changing display data from said card interface; and change said flexible display to display a plurality of changing images on said flexible display mounted on said front face according to said plurality of changing display data; and a game base comprising;

an electronic base circuit;

a base interface coupled to said electronic base circuit;

a base memory, coupled to said electronic base circuit, containing executable instructions for game rules; and a processor coupled to said electronic base circuit and said base memory to facilitate gameplay of said card game by applying said executable instructions for said game rules;

the game base operative to;

obtain a plurality of game-event data via said base interface as said card game progresses;

determine a plurality of changing card-states for said flexible electronic card according to said plurality of game-event data as said gameplay of said card game progresses; and as said gameplay of said card game progresses, communicate said plurality of changing card-states to said flexible electronic card via said base interface;

wherein said plurality of game-event data includes proximity data indicating that a second flexible electronic card is in physical proximity to said flexible electronic card.

92. The electronic game system of claim 91, wherein said flexible electronic card further comprises a touch-sensitive component.

93. The electronic game system of claim 91, wherein said input interface comprises an electronic connection.

94. The electronic game system of claim 91, wherein said card interface comprises a wireless connection.

95. The electronic game system of claim 91, wherein said card memory further stores ownership information indicating an identity of a card-game player who owns said flexible electronic card.

96. The electronic game system of claim 91:

wherein said card memory further stores ownership information indicating an identity of a card-game player who owns said flexible electronic card;

wherein said plurality of game-event data includes second ownership information indicating a second identity of a second card-game player who owns a second flexible electronic card; and wherein communicating said plurality of changing card-states comprises communicating said second ownership information to said card memory, and wherein said plurality of changing images includes an image indicating a transfer of ownership of the flexible electronic card from said card-game player to said second card-game player.

97. The electronic game system of claim 91, wherein said game base is further operative to log said plurality of game-event data and said plurality of changing card-states to said base memory.

98. The electronic game system of claim 91, further comprising a second flexible display coupled to said electronic circuit and mounted on said back face.

99. An electronic game system comprising:

a flexible electronic card comprising:

a flexible substrate in the form of a selected one of a playing card, a trading card, and a collectible card, said substrate having a front face and a back face and being suitable for being held in a player's hand as one of a plurality of like dynamic entertainment cards during a card game;

an electronic circuit coupled to said substrate;

a card interface coupled to said electronic circuit;

a flexible display coupled with said electronic circuit and mounted on said front face;

a card memory, coupled to said electronic circuit, containing card data; and the flexible electronic card operative to:

display a first image on said flexible display mounted on said front face according to said first card-state; and as said gameplay of said card game progresses:

obtain a plurality of changing display data from said card interface; and change said flexible display to display a plurality of changing images on said flexible display mounted on said front face according to said plurality of changing display data; and a game base comprising;

an electronic base circuit;

a base interface coupled to said electronic base circuit;

a base memory, coupled to said electronic base circuit, containing executable instructions for game rules; and a processor coupled to said electronic base circuit and said base memory to facilitate gameplay of said card game by applying said executable instructions for said game rules;

the game base operative to;

obtain a plurality of game-event data via said base interface as said card game progresses;

determine a plurality of changing card-states for said flexible electronic card according to said plurality of game-event data as said gameplay of said card game progresses; and as said gameplay of said card game progresses, communicate said plurality of changing card-states to said flexible electronic card via said base interface;

wherein said card memory further stores ownership information indicating an identity of a card-game player who owns said flexible electronic card;

wherein said plurality of game-event data includes second ownership information indicating a second identity of a second card-game player who owns a second flexible electronic card;

wherein communicating said plurality of changing card-states comprises communicating said second ownership information to said card memory, and wherein said plurality of changing images includes an image indicating a transfer of ownership of the flexible electronic card from said card-game player to said second card-game player.

100. The electronic game system of claim 99, wherein said plurality of game-event data includes proximity data indicating that a second flexible electronic card is in physical proximity to said flexible electronic card.

101. The electronic game system of claim 99, wherein said flexible electronic card further comprises a touch-sensitive component.

102. The electronic game system of claim 99, wherein said card interface comprises a wireless connection.

103. The electronic game system of claim 99, wherein said card memory further stores ownership information indicating an identity of a card-game player who owns said flexible electronic card.

104. The electronic game system of claim 99, wherein said game base is further operative to log said plurality of game-event data and said plurality of changing card-states to said base memory.

* * * * *